US005832850A

United States Patent [19]

Hurushita et al.

[11] Patent Number: 5,832,850

[45] Date of Patent: Nov. 10, 1998

[54] SEWING MACHINE WHICH PERFORMS A STITCHING OPERATION USING MULTIPLE KINDS OF THREADS

[75] Inventors: Tsugihiro Hurushita; Masanobu Watanabe, both of Ichinomiya, Japan

[73] Assignee: Kabushikikaisha Barudan, Japan

[21] Appl. No.: 860,010

[22] PCT Filed: Dec. 18, 1995

[86] PCT No.: PCT/JP95/02603

§ 371 Date: Jun. 16, 1997

§ 102(e) Date: Jun. 16, 1997

[87] PCT Pub. No.: WO96/19608

PCT Pub. Date: Jun. 27, 1996

[30] Foreign Application Priority Data

Dec. 19, 1994 [JP] Japan ..... 6-335019

[51] Int. Cl.[6] ..... D05B 87/00; D05B 53/00

[52] U.S. Cl. ..... 112/225; 112/294; 112/302; 112/DIG. 3

[58] Field of Search ..... 112/224, 225, 112/DIG. 1, DIG. 3, 285, 287, 293, 294, 302, 80.7, 78, 98

[56] References Cited

U.S. PATENT DOCUMENTS

| | | | |
|---|---|---|---|
| 3,713,605 | 1/1973 | Vahle et al. | 112/302 X |
| 4,023,512 | 5/1977 | Miyamoto | 112/225 X |
| 4,198,915 | 4/1980 | Peterson et al. | 112/225 |
| 5,165,352 | 11/1992 | Ingram | 112/80.7 X |
| 5,269,244 | 12/1993 | Cataletto | 112/302 |
| 5,603,462 | 2/1997 | Conrad et al. | 112/302 X |

FOREIGN PATENT DOCUMENTS

| | | | |
|---|---|---|---|
| 63-59993 | 3/1988 | Japan | 112/302 |

*Primary Examiner*—Peter Nerbun
*Attorney, Agent, or Firm*—William A. Drucker

[57] ABSTRACT

A sewing machine which performs a stitching operation using multiple kinds of threads has: a plurality of thread supplies; a thread selection device which selects and extracts an arbitrary thread from the plural threads supplied from the thread supplies; a stitching needle; and means for nipping a front end portion of the thread extracted by the selection device, and for bringing the front end portion to the needle. The thread extracted and selected by the selection device is brought to the needle while the front end portion is mechanically nipped.

4 Claims, 30 Drawing Sheets

SEWING MACHINE WHICH PERFORMS A STITCHING OPERATION USING MULTIPLE KINDS OF THREADS

TECHNICAL FIELD

The present invention relates to a sewing machine which performs a stitching operation with selectively using multiple kinds of threads supplied from respective thread supply sources.

BACKGROUND ART

Technical matters of a sewing machine of this type are described in, for example, Japanese Patent Publication (Kokai) No. HEI6-254277. The contents of the publication are partly quoted in "Column of the Prior Art" below. FIGS. Nos. 1, 2, 3, 4(A), 4(B), 9, and 10 of the publication are transcribed to the drawings of the present application. In order to distinguish the quoted figures from FIGS. 1 to 45 showing embodiments of the invention, the figure numbers of the quoted figures are indicated in the instant application as 46, 47, 48, 49A, 49B, 50, and 51, respectively. In the column of the prior art, therefore, FIGS. Nos. 1, 2, 3, 4(A), 4(B), 9, and 10 correspond to FIGS. 46, 47, 48, 49A, 49B, 50, and 51, respectively, of the instant application

COLUMN OF THE PRIOR ART

In FIGS. 1 and 2 showing the entire configuration of one head of a multihead multicolor sewing machine, 1 designates a frame or so-called bridge which is used in the multihead multicolor machine and elongates horizontally, 2 designates one machine mounted on the bridge 1, 3 designates a head of the machine, and 4 designates a head frame which is attached to the frame 1. The reference numerals 5, 6, 7, and 8 indicate the existence of a needle bar, a stitching needle which is provided at the lower end of the needle bar, a presser foot, and a take-up device, respectively. These components have well-known configuration, and are vertically reciprocated by a lifting mechanism which is not shown, as well known in the art. Next, the configuration for supplying color threads will be described. The reference numeral 9 designates thread supplies. In order to supply threads which are different from each other in color and size, the machine is provided with a plurality of thread supplies 9. The reference numeral 10 designates a selection device for selectively feeding out one of the threads supplied from the thread supplies 9. The reference numeral 11 designates retraction devices by which, when the stitching thread is to be changed to another one, the currently used thread is retracted to the selection device 10 so as to be returned to a preparatory state, and 12 designates a tension device for applying a fixed tension to the stitching thread. The reference numeral 14 designates a thread passing device for conducting thread passing from the selection device 10 to the take-up device 8, and 15 designates a thread passing device for conducting thread passing from the take-up device 8 to the needle 6. The reference numeral 16 generally indicates the existence of a well known bed of the machine, and, in the figure, designates the upper face of the bed. As well known, the bed is provided with a throat plate, and a well known shuttle is disposed under the throat plate. A well known cutting device for cutting the needle thread and the bobbin thread is disposed between the throat plate and the shuttle Next, FIGS. 3 to 8 showing the selection device 10 will be described. The selection device 10 consists of a body 22 and an operating unit 23 surrounding it. In FIG. 3, 24 designates a casing of the body. The casing consists of a body member 25 which is substantially cylindrical and incorporates a configuration for selecting a thread, and two members constituting a thread guide passage, i.e., a first guide member 26 which has a conical shape, and a second guide member 27 which has a cap-like shape. The reference numeral 26*a* designates a threaded connecting portion, 25*a* and 27*a* designate flanges for connecting the second guide member 27 with the body member 25, and 28 designates a gasket for preventing air leakage from occurring. The outer side face of the first guide member 26 and the inner side face of the second guide member 27 are formed as sliding faces so that a thread can smoothly slide over the faces. The reference numeral 33 designates thread inlets. A number of thread inlets 33 (e.g., 16 inlets) are arranged on a circumference of a circle centered at the axis of the body member 25. The reference numeral 34 designates a thread outlet, and 35 designates holding portions which hold front ends of the threads introduced from the thread inlets 33 and are formed as small through holes respectively communicating with the thread inlets 33. The reference numeral 36 of FIG. 3 designates a guide passage which connects the holding portions 35 with the outlet 34. The reference numeral 61 of FIGS. 1 and 2 designates a thread guide for guiding threads to the respective inlets 33.

Referring to FIG. 3, drive means for feeding out threads from the holding portions 35 through the outlet 34 will be described. The drive means consists of a plurality of first drive means 37 which are respectively provided at the holding portions 35 in order to transport a thread in each holding portion 35 to the middle of the guide passage 36, and one second drive means 38 which further transports the thread transported to the middle of the guide passage 36, to the outlet 34, and feeds out the thread through the outlet 34.

Next, FIG. 6 showing the operating unit 23 in detail will be described. . . . The reference numeral 133 designates a valve for opening and closing the air passage to the respective air supply ports. . . . The reference numeral 146 designates the electromagnet which operates the valve 133.

FIG. 9 shows the relationship between the first and second drive means 37 and 38 of the body 22, the valves 133 of the operating unit 23, and the air supply 129. The valves corresponding to the first drive means 37 are respectively designated by reference numerals 133*a*, 133*b*, 133*c*, . . . , and the valve corresponding to the second drive means 38 is designated by 133A.

The retraction devices 11 shown in FIG. 2 are respectively disposed in the thread passages between the plurality of thread supplies 9 and the selection device 10 so that they are individually disposed in each of the thread passages between the thread supplies 9 and the take-up device 8. For example, the retraction devices are attached to support frames 1*a* which are fixedly arranged above the frame 1. FIGS. 10 to 13 showing the retraction devices 11 in detail will be described. . . . The reference numeral 64 designates a drum which is made of a synthetic resin. . . . The reference numeral 68 designates a through hole for guiding a thread from the thread supply toward the outer face of the drum.

The reference numeral 69 designates the winding member which is made of a synthetic resin and rotatable about the axis of the drum 64. . . . The reference numeral 71 designates a thread guide portion which is formed as a through hole. The both end openings of the thread guide portion are provided with guide members 71*a*and 71*b* which are made of a high wear-resistant hard material such as alumina. The opening 72 at the end of the thread guide portion 71 in the side of the drum 64 is located in the side of the outer face of the guide slope 66. The reference numeral 74 designates a motor for rotating the winding member 69. In order to accurately control the rotation angle of the winding member 69, a pulse motor is used as the motor 74.

Next, both the thread passing devices 14 and 15 of FIGS. 1 and 2 are known devices which use, for example, air.

Next, 90 designates a thread catch mechanism which is disposed on the peripheral side wall 63*c* of the base 63 and causes the progress of a thread to be halted. . . . 95 designates a cancellation member for canceling the operation of the thread catch mechanism 90

Next, the operation of the machine having the configuration described above will be described. At first, as a preparatory work, the bobbin 21 on which the thread 20 is wound is mounted onto the bobbin holder 19 in each thread supply 9, and the thread 20 drawn out from each of the bobbins is led to the selection device 10 through a thread guide 81, the retraction device 11, the tension device 12, and the thread guides 84 and 61. In the retraction device 11, as shown in FIG. 10, the thread guide portion 71 is opposed to the through hole 68 so that the thread 20 is passed therethrough as shown by the two-dot chain line. In the selection device 10, as shown in FIG. 3, the front ends of the threads 20 are inserted into the respective inlets 33 to reach the holding portion 35.

Under this state, the control device such as a computer controls on the basis of predetermined programs the operations of the devices in the following manner: First, in the retraction device 11 which relates to the thread to be used in the stitching, the solenoid 95 is energized to set the thread catch mechanism 90 to the cancellation state as shown in FIGS. 10 and 11(A). Also in the tension device 12 which relates to the thread, the application of the tension is canceled so as to set the thread to a free state. Under this state, in FIG. 9, the valve 133A and a valve, for example, the valve 133*a* which relates to the first drive means 37 corresponding to the thread are opened. . . . The air which has passed through the valve 133A flows in the second drive means 38 . . . to be vigorously ejected from the discharge opening 60 toward the outlet 34. The air which has passed through the valve 133*a* flows in the first drive means 37 . . . to be vigorously and straightly ejected from the ejection opening 51 toward the holding portion 35. The air flow from the first drive means 37 causes the lower end of the thread 20 in the holding portion 35 to move from the holding portion 35 to the guide passage 36 shown in FIG. 3, and then reaches the small-width portion which is indicated by 36*a* and located in the lower part of the guide passage 36. In the small-width portion 36*a*, the air ejected from the discharge opening 60 of the second drive means 38 produces an air flow which is directed from the small-width portion 36*a* to the outlet 34. Therefore, the thread which has reached the small-width portion 36*a* is further advanced by the air flow to reach the outlet 34, and then fed out downwardly therefrom. When the thread to be used in the stitching is fed out from the outlet 34 in this way, the valves 133A and 133*a* are closed to stop the air flow.

The thread 20 which is fed out from the outlet 34 as described above is caused to pass through the take-up device 8 by the thread passing device 14 of FIGS. 1 and 2, and to pass through the needle eye of the needle 6 by the thread passing device 15.

When the thread to be used in the stitching is passed through the needle 6 as described above, the tension device 13 relating to the thread enters the state where a tension is applied to the thread. Further, as well known, the main shaft of the machine begins to be rotated so that vertical reciprocation of the needle 6 and rotation of the shuttle are started. The take-up device 8 operates together with the movement to conduct the stitching on the cloth on the bed in the same manner as a well-known sewing machine. In the retraction device 11, the thread 20 proceeds in the route shown by the two-dot chain line in FIG. 10 and in the direction of the arrow 20*a*."

In the sewing-machine of the prior art, a thread is pulled down by air from the selection device to the needle. Therefore, the machine has a problem in that the pulling-down operation often results in failure.

The sewing machine of the invention is provided in order to solve the problem of the prior art.

It is an object of the invention to enable an arbitrary thread from a plurality of threads which are previously prepared, to be selected, and a stitching operation to be conducted using the selected thread.

It is another object to enable the selected thread to be automatically loaded to a needle by mechanical means.

It is a further object to, when the thread selected and extracted by a thread selection device is to be passed through the thread eye of the needle, enable the extracted thread to be mechanically nipped and passed through the thread eye while being nipped.

Generally, a thread is configured by twisting plural filaments.

Each time when an external force is repeatedly applied to the front end of a thread, therefore, ends of filaments are loosened to spread over, whereby the work of passing the thread through a needle in a succeeding process is made difficult to do. If the end of a thread is nipped and the thread is brought to the vicinity of the thread eye of the needle without again performing the nipping operation, the front end of the thread can be prevented from being loosened, thereby facilitating the thread passing work.

It is a further object to, in the above case, enable both operations of bringing a caught thread to the needle and passing the thread through the thread eye of the needle, by disposing a thread catch mechanism in a front end portion of an arm the basal portion of which is rotatably attached, and by using an arcuate movement of the arm.

It is a further object to provide a thread selection device which can select an arbitrary thread from a plurality of threads that are brought to respective inlets and feed the thread from a single common outlet to an extraction place.

It is a further object to feed out the thread without producing mechanical deformation, by conducting the selection and feeding out by an air flow.

It is a further object to, even when the thread is fed out from the output to the extraction place by an air flow, or even when there is a possibility that the thread is bent by the air flow so as to be laterally fluctuated, enable the thread fed to the extraction place to be positioned in a lateral direction at a fixed position.

It is a further object to enable the front end portion of the thread fed to the extraction place to be cut at a fixed position, so that a thread of a constant length remains in the extraction place.

It is a further object to, when the front end portion of the thread is to be cut, enable the cutting operation to be conducted in a state where the front end of the thread in the side remaining in the extraction place after the cutting operation is kept to be straight.

It is a further object to, when the one selected thread is to be guided to the outlet by the air flow in the selection device, enable the thread to be smoothly guided to the outlet without producing a tangle in the thread.

It is a further object to, when the thread is to be passed through the thread eye of the needle, enable the thread to be guided toward the thread eye by a guide hole, so that the passing operation can be surely conducted.

It is a further object to enable the above-mentioned guide to be conducted even when the thread is deviated to any side of the whole periphery of the guide hole.

It is a further object to, after the thread is passed through the thread eye of the needle, enable means for the guide to be easily separated from the thread.

Other objects and advantages of the invention will become apparent in the following description taken in connection with the accompanying drawings.

DISCLOSURE OF INVENTION

The sewing machine of the invention which performs a stitching operation with using multiple kinds of threads comprises: a plurality of thread supplies 9 for respectively supplying threads for stitching; a thread selection device A which selects and extracts an arbitrary thread from plural threads 20 supplied from the thread supplies 9; a stitching needle 6; and means F for nipping a front end portion of the thread 20 extracted by the selection device A, and for bringing the front end portion to the needle.

According to the sewing machine of the invention which performs a stitching operation with using multiple kinds of threads, a desired thread can be selected from the multiple kinds of threads and a stitching operation can be performed with using the selected thread.

Furthermore, the operation of bringing the selected thread to the stitching needle can be conducted while mechanically nipping the front end portion of the thread. Therefore, the thread 20 can be surely brought to the needle 6.

The operation of bringing the thread is conducted by an arm one end of which is pivotally supported at a position higher than the needle. Therefore, it is possible to, as the arm is downwardly tilted and a catch mechanism approaches the needle, increase the horizontal movement component of the catch mechanism. The horizontal movement component causes the front end portion of the thread nipped by the catch mechanism to be passed through the thread eye of the needle. This has an advantage that a single action of tilting the arm enables both operations of bringing the thread from the thread selection device to the needle and passing the thread through the thread eye of the needle, with the result that the time required for conducting the operations can be shortened.

In the case where the thread selection device comprises a thread positioning mechanism and a cutting device, the front end portion of a thread can be cut off after the thread is first positioned in an extraction place and the thread is caught by the catch mechanism. This enables the front end portion of the thread nipped by the catch mechanism to slightly protrude from the catch mechanism. As a result, even an unstiff thread can be kept in the state where the front end portion of the thread straightly elongates, and hence the operation of passing the thread through the thread eye of the needle can be adequately conducted.

According to the thread selection device of the invention, when one threshold is selected and extracted from the plural threads, the thread is moved by an air flow. Therefore, the thread can be extracted under a floating state, so that the thread is prevented from being damaged in the selection and extraction step.

When a thread is fed out by an air flow as described above, the extracted thread is laterally fluctuated. In contrast, according to the invention, the extracted thread can be positioned at a fixed position by a positioning device. This enables the extracted thread to be transferred in close connection to operation means in the next stage, such as means for transporting the thread toward the needle, and these operations can be continuously automatically conducted.

Furthermore, the thread which is positioned at the extraction place can be subjected at a predetermined position to an operation of cutting the front end of the thread. Therefore, the thread remaining in the extraction place can always have a constant length. This further facilitates the automatization of the handling of the thread in the next stage such as that described above.

In the operation of cutting a thread, blades of a pair of cutting members of the cutting device can meet at the positioning place of the thread so as to cut the thread. Therefore, the thread can be cut without being laterally moved by the cutting members. This means that the linearity of the front end of the thread which has undergone the cutting operation and remains at the positioning place can be maintained. When the thread is to be passed through the thread eye of the needle in the next step, for example, this enables the passing operation to be smoothly conducted.

According to the thread extraction method of the invention, when one thread is to be selected from the threads in a plurality of holding portions, the thread is moved by air flows caused by first and second drive means. Therefore, the movement of the thread from the holding portion to a guide passage can be surely conducted. After the thread is moved as described above and the thread rides on the air flow caused by the second drive means, the amount of the air of the second drive means is reduced, so that the thread is prevented from tangling in the guide passage, thereby enabling the thread to be smoothly fed out from an outlet.

According to the thread passing mechanism of the invention, when a thread is to be passed through the thread eye of the stitching needle, a guide hole disposed in guiding means is closed in the whole periphery. Therefore, the thread can be surely guided to the thread eye even when the thread is deviated to any side of the guide hole.

Furthermore, the guiding means is configured by two members which can be split from each other so that a range of the guide hole from one end to the other end is divided into two portions. After the thread is passed through the thread eye, therefore, the thread can be easily removed from the guide hole by splitting the guiding means into two portions.

BRIEF DESCRIPTION OF DRAWINGS

At FIG. 40A is a longitudinal section view showing another example of the shape of a holding portion in the thread passing mechanism.

BEST MODE FOR CARRYING OUT THE INVENTION

Figure 1:
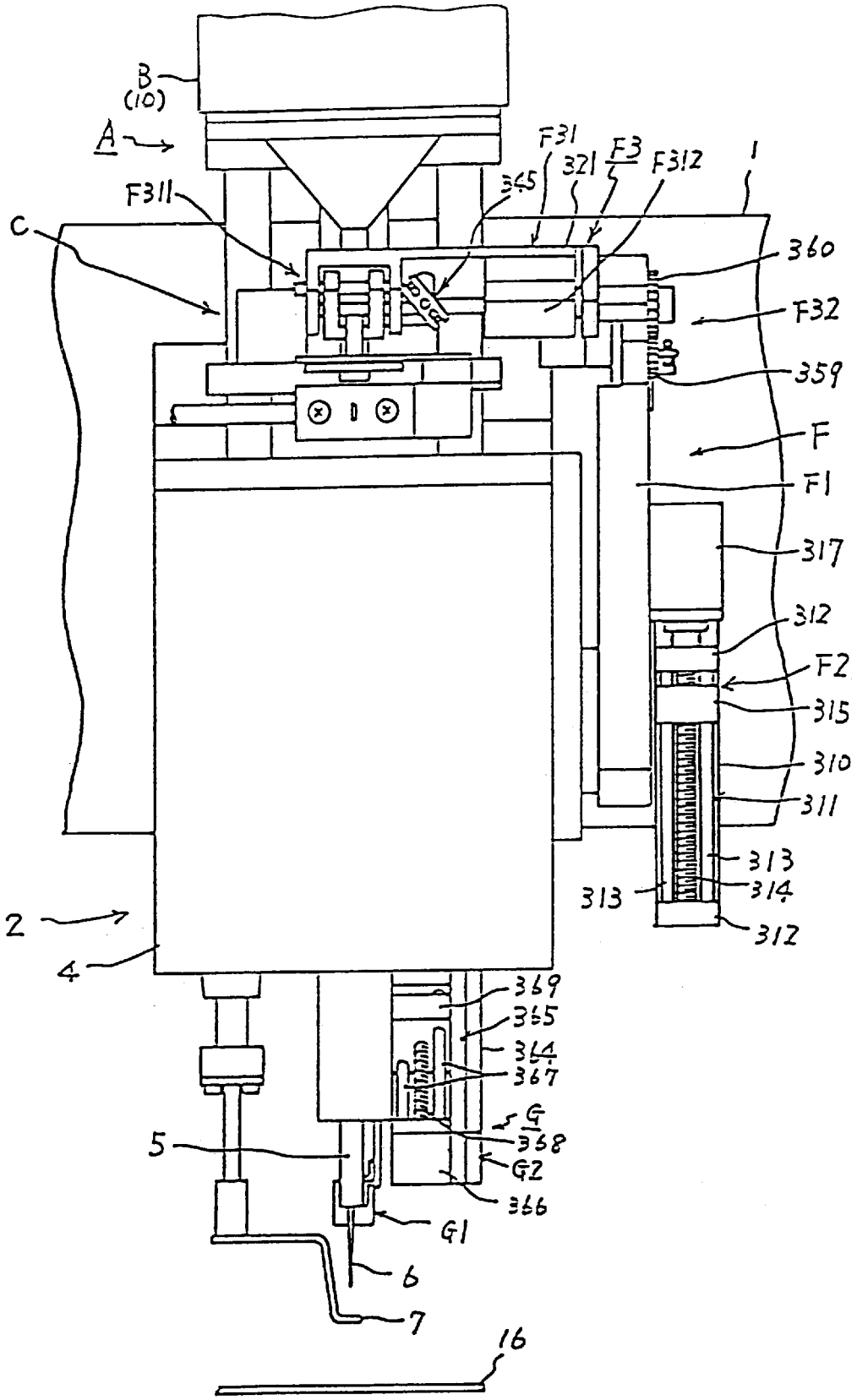
FIG. 1 is a front view of a sewing machine.
Figure 2:
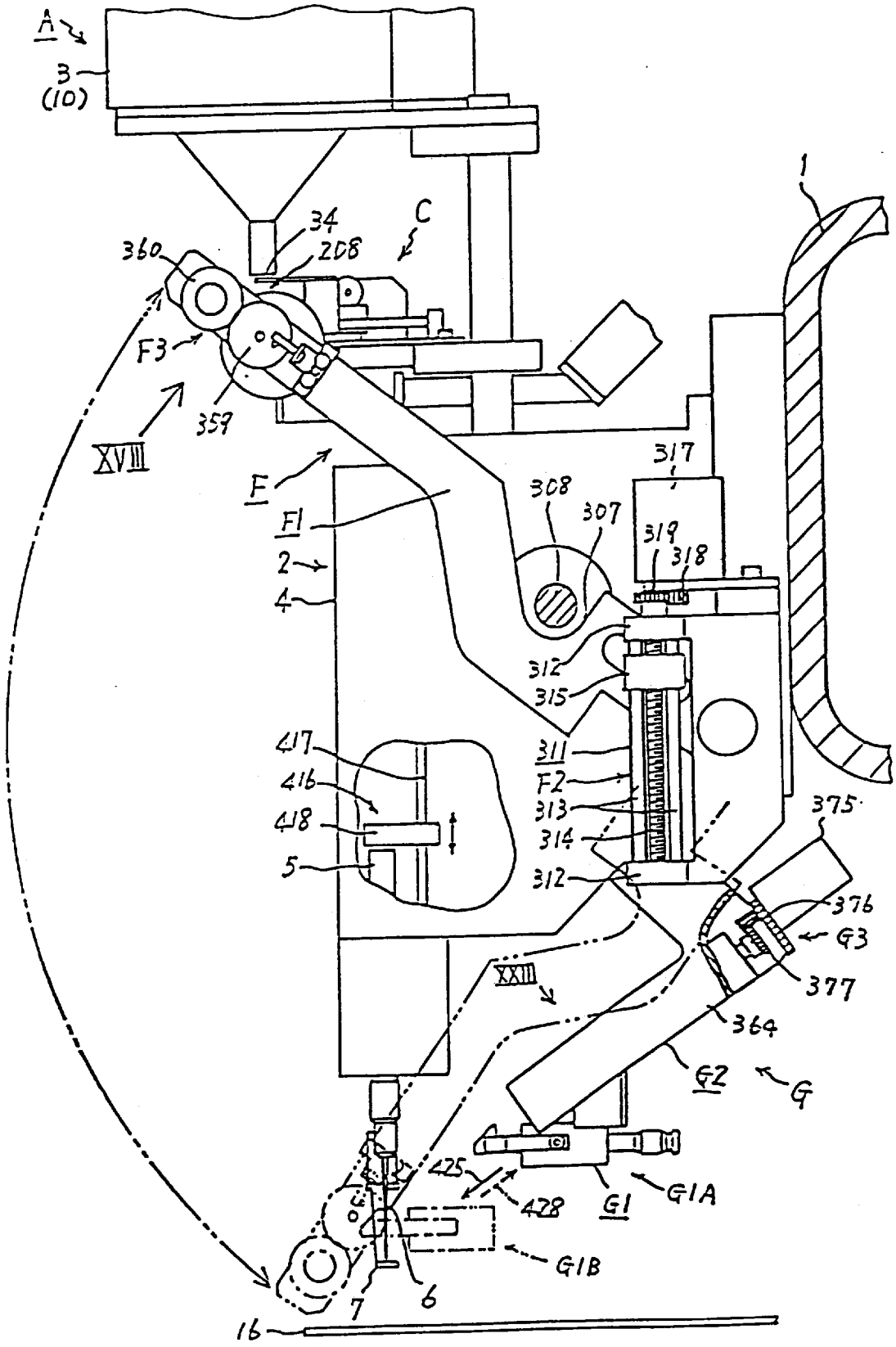
FIG. 2 is a side view of the sewing machine.

Hereinafter, embodiments of the invention will be described with reference to the drawings. In FIGS. 1 and 2, members designated by reference numerals 1, 4, 5, 6, and 10 are a frame, a head frame, a needle bar, a needle, and a selection device which are used in a known sewing machine (for example, known in Japanese Patent Publication (Kokai) No. HEI6-254277), respectively. The relationships among these members, and these members and other members are configured in the same manner as those among the corresponding members described in the prior art column, and these members and other members. In FIGS. 1 to 4, 12, 36, and 41 to 45, portions which are identical or equivalent in function to those shown in FIGS. 46 to 51 and the description of which may be duplicated are designated by the same reference numerals as those of FIGS. 46 to 51, and duplicated description is omitted.

Figure 3:
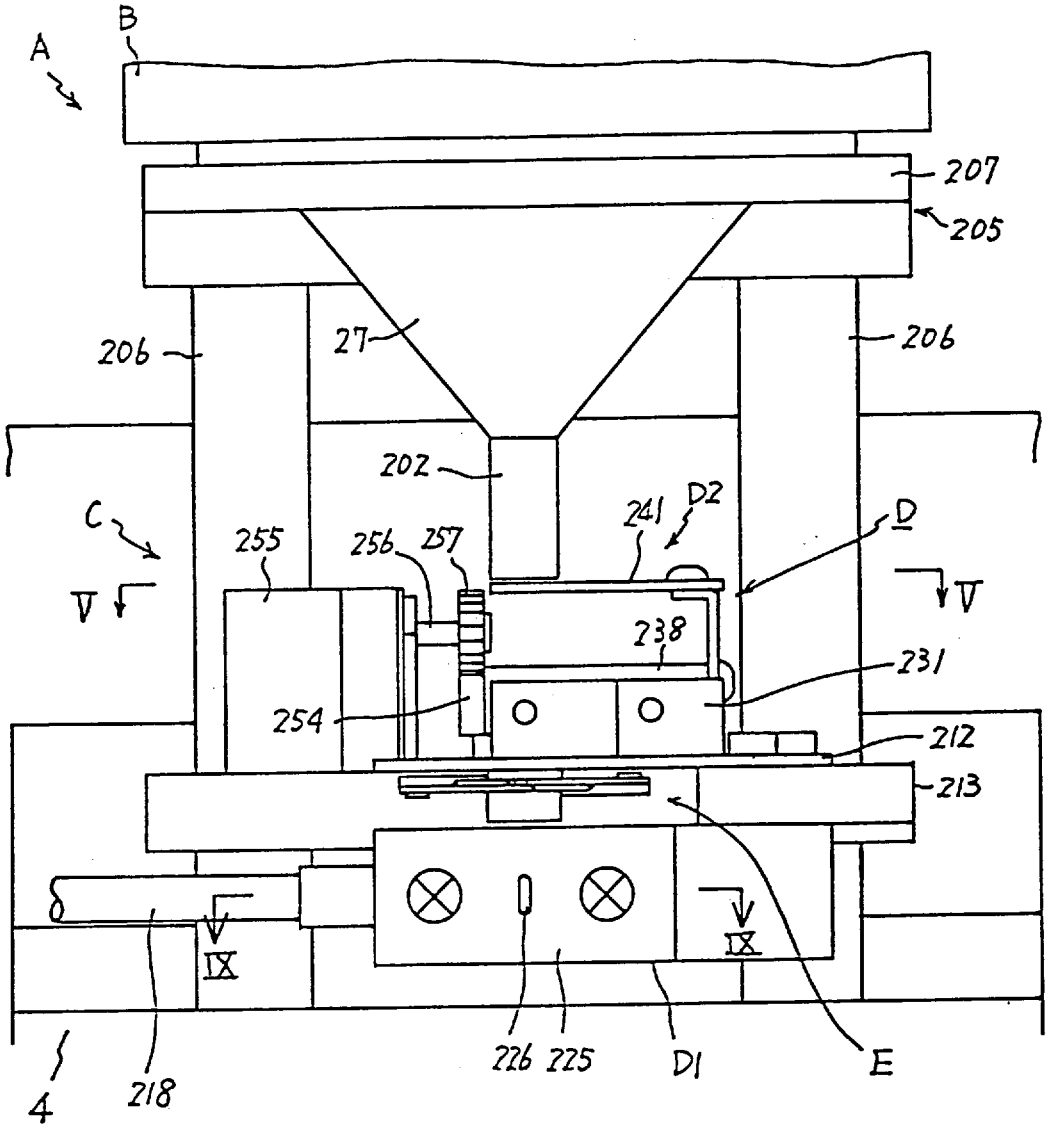
FIG. 3 is a front view of a thread selection device.
Figure 4:
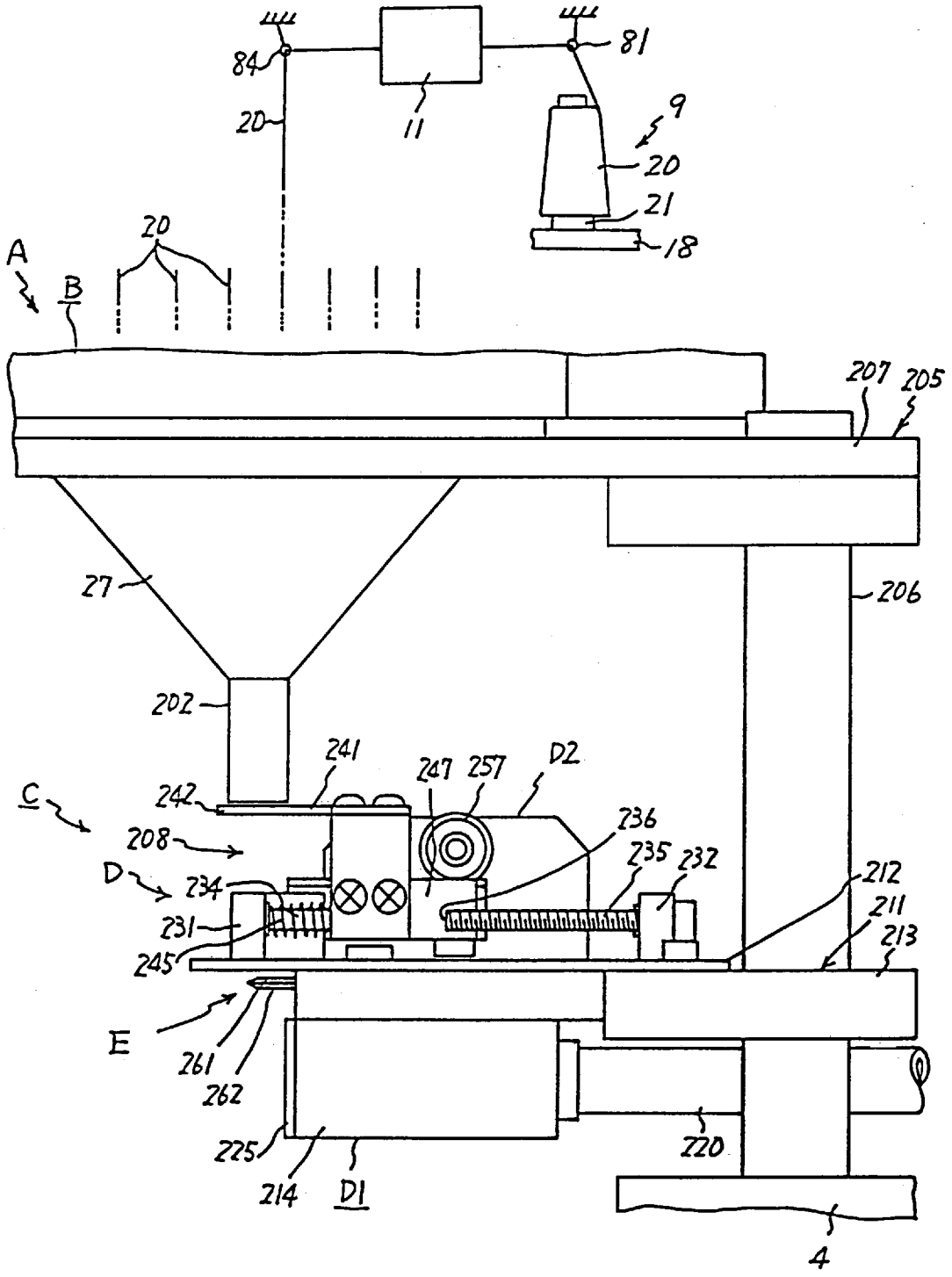
FIG. 4 is a side view of the thread selection device.

In FIGS. 3 and 4, A designates a thread selection device for selecting and extracting a desired thread from multiple kinds of threads supplied from a plurality of thread supplies. The multiple kinds of threads means various kinds of threads which are used in stitching or embroidery, such as threads different in color, size, shape, etc. The thread selection device A is configured by a selection mechanism B which selects and extracts a thread, and a thread end process mechanism C which processes an end of the extracted thread.

First, the selection mechanism B will be described. As the mechanism B, the selection device 10 described in the prior art column is used, but the structure is partly modified. The modified portion will be described with reference to FIG. 7. The reference numeral 201 designates an inner peripheral face of the second guide member 27 and functioning as a guide face for guiding a thread fed out from the holding portion 35. The reference numeral 202 designates a guide pipe which is formed at the lower end of the second guide member 27 and guides the thread guided by the guide face 201 toward the outlet 34. In order to prevent the thread guided by the guide face 201 (particularly, a stiff thread tends to straightly proceed along the guide face 201 and the extension line 201*a* of the face) from abutting against an outer peripheral face 204 of the first guide member 26, a lower end 203 of the first guide member 26 is set to be at a position which is upwardly retracted from the extension line 201*a* of the guide face 201. This positional setting allows the thread which has been fed out from the holding portion 35 by the air flow and lowered along the guide face 201 of the guide passage 36, to be smoothly fed into the guide pipe 202 by air ejected from the discharge opening 60 and then fed out from the outlet 34 without abutting against the outer peripheral face 204 of the first guide member 26 or winding around the member. In order to allow the air ejected from the discharge opening 60 to enter the guide pipe 202 smoothly (without striking against the guide face 201), the lower end 203 is preferably formed at a low position which is as close as possible to the guide pipe 202. Therefore, the position of the lower end 203 is preferably decided in consideration of both the above-mentioned conditions. The reference numeral 205 designates an attaching member for attaching the selection mechanism B to the head frame, 206 designates a post fixed to the head frame 4, and 207 designates an attaching bracket attached to the post 206. The selection mechanism B is attached to the attaching bracket 207. The reference numeral 208 designates a thread extraction place which is defined on the extension line of the guide pipe 202 and to which the thread is fed out from the outlet 34 through the guide pipe 202.

Next, the thread end process mechanism C will be described. In FIGS. 3 and 4, D designates a positioning device for positioning the front end portion of the thread fed out from the outlet 34 of the selection mechanism B, at a predetermined position. The device is disposed along the thread extraction place 208. E designates a cutting device for cutting the thread positioned by the positioning device D, at a predetermined position. The device is disposed along the thread extraction place 208 in the same manner as the positioning device D.

The positioning device D will be described with reference to also FIGS. 5 to 8. The reference numeral 211 designates a base member which functions as a base member for supporting various members of the device D and is configured by a base plate 212 and an attaching bracket 213 for attaching the plate to the post 206. D1 designates a clamping device which is attached to the base plate 212, and which positions and holds the lower end portion of the thread fed out from the outlet 34 to the extraction place 208, at a predetermined position by means of air suction. D2 designates a positioning device which is attached to the base plate 212, and which positions the upper end portion of the thread fed out to the extraction place 208, at a predetermined position.

Figure 7:
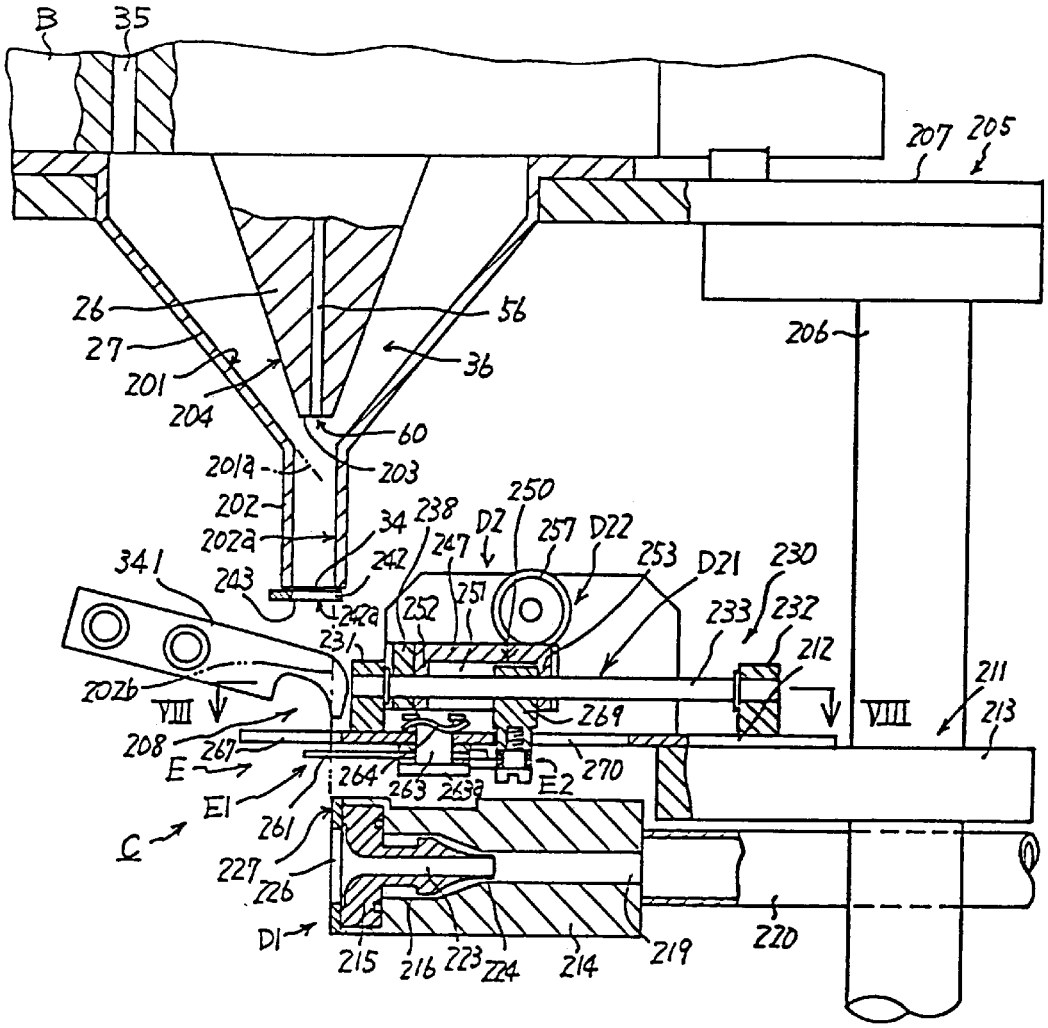
FIG. 7 is a longitudinal section view of the thread selection device.
Figure 9A:
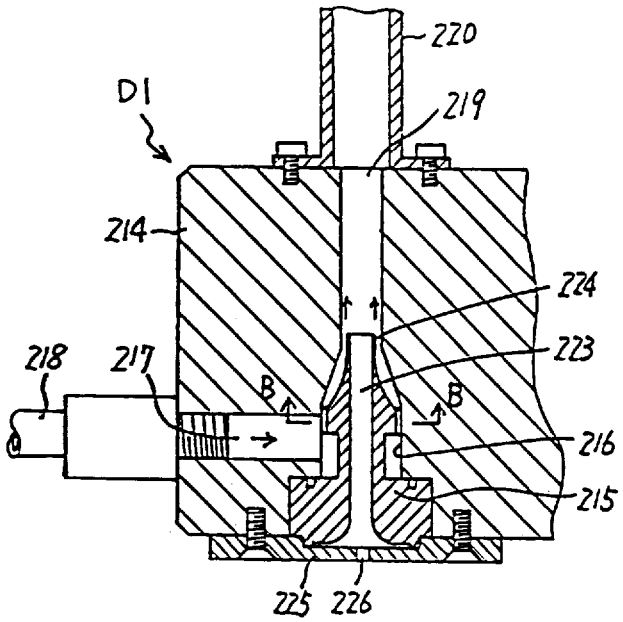
FIG. 9A is a horizontal section view of a clamping device (a section view taken on the line IX—IX of FIG. 3)
Figure 9B:
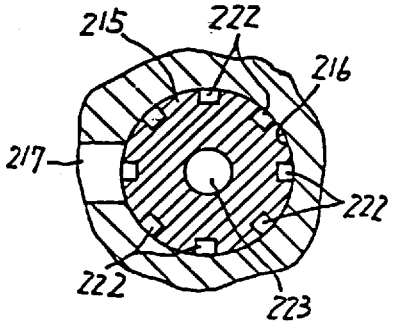
FIG. 9B is a section view taken on the line B—B of FIG. 9A.

FIGS. 4, 7, and 9 showing the clamping device D1 will be described. For example, the clamping device D1 is configured so as to produce a suction force on the thread with using the air ejection force. The device is configured by a base member 214 attached to the base plate 212, and a nozzle member 215 incorporated in the member. The base member 214 will be described. The reference numeral 216 designates a through hole for attaching a nozzle member 215, 217 designates an air reception port which communicates with the nozzle hole 216, 218 designates a hose which is an example of a pipe for supplying air to the reception port 217, 219 designates a discharge port for air and thread pieces, and 220 designates a hose for discharging the air and thread pieces. Next, the nozzle member 215 will be described. The reference numeral 222 designates air grooves formed in the periphery. In order to straightly eject air in parallel with an axis of the nozzle member 215, the grooves are formed in parallel with the axis. The reference numeral 223 designates a through hole into which a thread is to be pulled. When the nozzle member 215 is attached to the through hole 216, a small-width air ejection port 224 which forms a throat portion is configured between an outer peripheral face of the member 215 and an inner peripheral face of the through hole 216. The reference numeral 225 designates a fixing plate for fixing the nozzle member 215 to the base member 214, and 226 designates a suction port formed in the fixing plate 225. As shown in FIG. 3, the length of the suction port 226 in the longitudinal direction is made large so that a thread which arrives at the front portion with being hung in the longitudinal direction is easily pulled into the port, and the lateral width is made small so that the lateral positioning accuracy of the pulled-in thread is enhanced. The reference numeral 227 designates a thread positioning portion which is configured by a front face of the fixing plate 225 which is above the suction port 226. The thread pulled into the suction port 226 is caused to abut against the positioning portion 227, thereby allowing the positioning portion 227 to conduct the thread positioning in the lateral direction in FIG. 7. The positioning portion 227 is set at a position on an extension line 202*b* of an edge portion 202*a* which is on the inner peripheral face of the guide pipe 202 and at the rightest position of FIG. 7. In the thus configured clamping device D1, when compressed air is supplied to the reception port 217 through the hose 218, the air is straightly vigorously ejected from the ejection port 224 toward the discharge port 219, so that a negative pressure is generated in the through hole 223. This negative pressure produces the suction force in the suction port 226.

Figure 5:
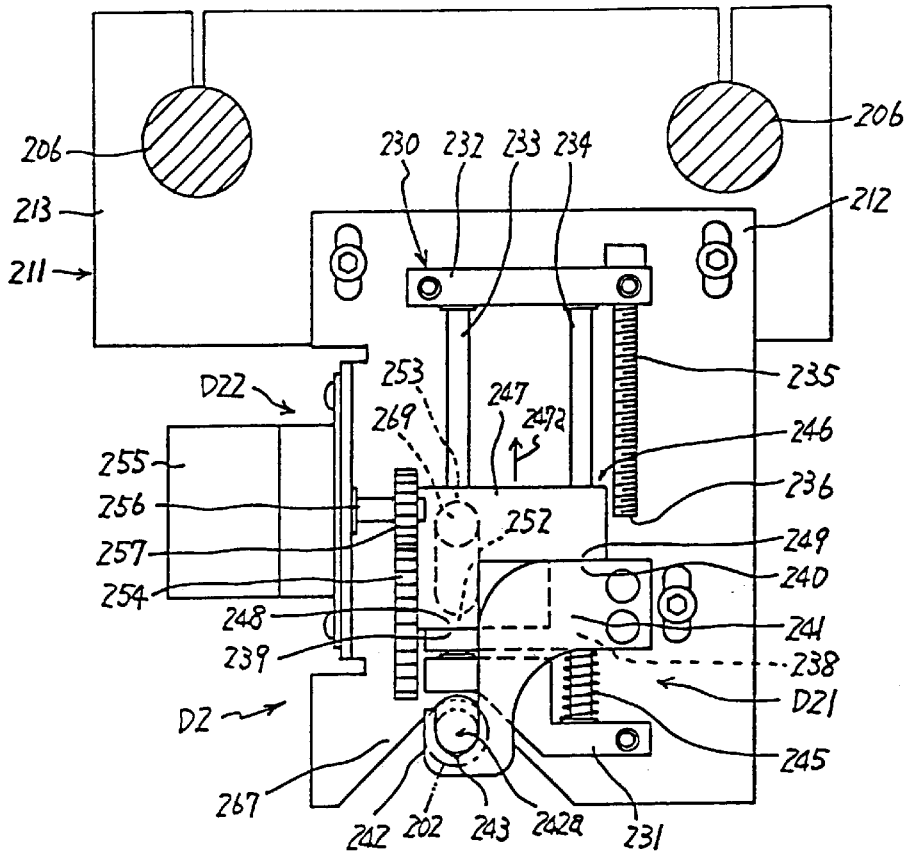
FIG. 5 is a plan view of a positioning device (a section view taken on the line V—V of FIG. 3).

FIGS. 4 to 8 showing the positioning device D2 will be described. The positioning device D2 is configured by a positioning mechanism D21 for conducting the thread positioning operation, and a driving mechanism D22 for driving the mechanism D21. First, the positioning mechanism D21 will be described. The reference numeral 230 designates a supporting mechanism for supporting a movable unit (which will be described later) of the mechanism D21 so as to be reciprocally movable in a predetermined range in a predetermined place. This mechanism will be described. The reference numerals 231 and 232 designate supporting bodies which are attached to the base plate 212 for the clamping device D1 so as to commonly use the plate. The reference numerals 233 and 234 designate guiding rods which are attached to the supporting bodies 231 and 232. The reference numeral 235 designates a positioning member which is used for positioning the movable unit described later, and which is configured by, for example, a bolt. An front end 236 functions as a receiving portion for positioning. The bolt 235 is screwed into a tapped hole 237 formed in the supporting body 232. The reciprocal movement in the axial direction due to the rotation of the bolt 235 changes the position of the receiving portion 236 so that the position at which the movable unit is positioned is variable. Next, the movable unit of the positioning mechanism D21 will be described. The reference numeral 238 designates a movable block which is reciprocally attached to the guiding rods 233 and 234, and which comprises engaging portions 239 and 240 to be engaged with the driving mechanism D22. The reference numeral 241 designates an attracting piece. A basal portion of the piece is attached to the movable block 238. The reference numeral 242 designates a surrounding portion which is disposed at a front end position of the attracting piece and formed into an arcuate shape which opens only in the side in the attracting direction of the attracting piece 241 (the upper side in FIG. 5). An inner side 242*a* of the portion is used as a passage for a thread. The surrounding portion 242 is disposed so as to form a positional relationship in which, under the state where the positioning device D2 is not operated, the thread passage 242*a* of the inner side overlaps with the interior of the guide pipe 202. The reference numeral 243 designates an attracting portion for attracting a thread. The portion is configured by the bottom portion of the surrounding portion 242. The attracting portion 243 is formed into a V-like shape in a plan view as shown in FIG. 5, and a thread is attracted by the bottom portion of the V-like shape, whereby the attracted position of the thread (the position in the lateral direction in FIG. 5) is uniformized.

Next, the driving mechanism D22 will be described. The reference numeral 245 designates a spring for producing a driving force which enables the movable block 238 to conduct the attracting operation, and which is a compression spring interposed between the supporting body 231 and the movable block 238. The reference numeral 246 designates an operating mechanism for controlling the movement of the movable block 238 urged by the spring 245. Hereinafter, the mechanism 246 will be described. The reference numeral 247 designates an operation block which is reciprocally attached to the guiding rods 233 and 234, and which comprises engaging portions 248 and 249 to be engaged with the engaging portions 239 and 240 of the movable block 238. The reference numeral 250 shown in FIGS. 7 and 8 designates an interlocking portion which is disposed in the operation block 247 and interlocks the block with a driving mechanism E2 (which will be described later) of the cutting mechanism E, 251 designates a cutaway portion for placing a driving body, and 252 and 253 designate engaging portions for engaging with the driving body. Next, a mechanism for operating the operation block 247 will be described. The reference numeral 254 designates a gear rack attached to the operation block 247, and 255 designates a motor attached to the base plate 212 which is, for example, a geared motor. The reference numeral 256 designates a rotating shaft of the motor, and 257 designates a pinion gear which is attached to the rotating shaft and meshes with the gear rack 254.

Figure 6A:
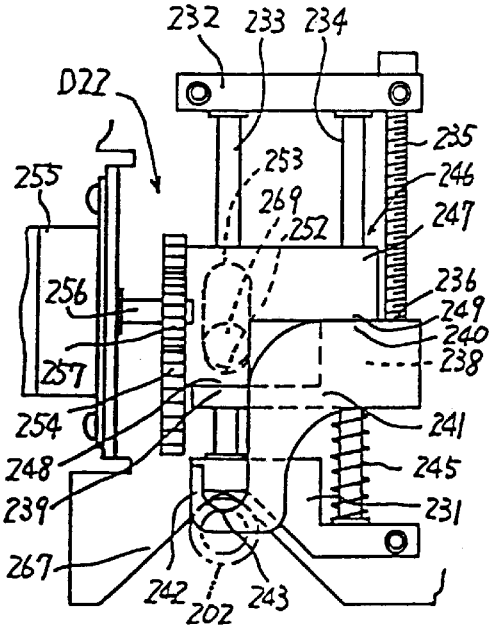
FIGS. 6A and 6B are plan views illustrating the operation of the positioning device.
Figure 6B:
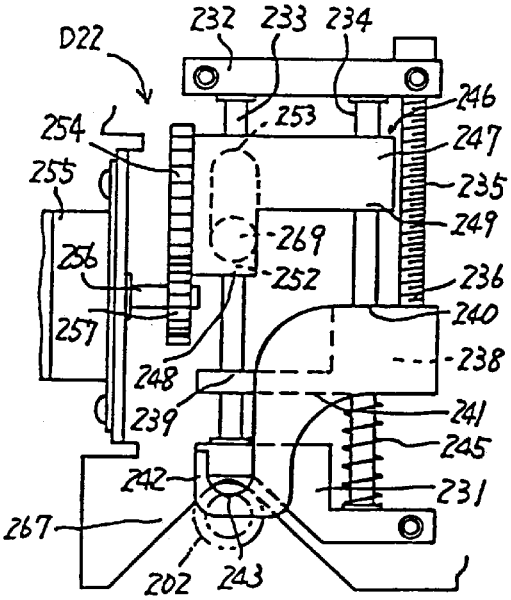

In the thus configured positioning device D2, when the device D2 is not operated, the operation block 247 is at the position of FIG. 5, the engaging portions 239 and 240 of the movable block 238 abut against the engaging portions 248 and 249 of the operation block 247 and are at the illustrated positions, and the attracting piece 241 is at the retraction position where the surrounding portion 242 surrounds the extraction place 208 at the lower edge of the outlet 34 of the selection mechanism B. When the operation block 247 is moved in the direction of an arrow 247*a* by the rotation of the rotating shaft 256 of the motor 255 through the pinion gear 257 and the gear rack 254, the movable block 238 which receives the urging force of the spring 245 is moved with following the movement. When the attracting portion 243 of the attracting piece 241 reaches a predetermined positioning position (a position on the extension line 202*b* of the edge portion 202*a* which is on the inner peripheral face of the guide pipe 202) as shown in FIG. 6A, the movable block 238 abuts against the receiving portion 236 of the stopper 235 and stops at the position. When the motor 255 continues to operate, the operation block 247 is moved as shown in FIG. 6B. By contrast, when the rotating shaft 256 of the motor 255 rotates in the opposite direction, the operation block 247 is returned from the state of FIG. 6B to that of FIG. 6A and the engaging portions 248 and 249 engage with the engaging portions 239 and 240 of the movable block 238. Thereafter, the movable block 238 integrated with the operation block 247 is returned to the position of FIG. 5, and the attracting piece 241 is returned to the retraction position. Between the states of FIGS. 6A and 6B, the operating mechanism 246 functions as a part of the driving mechanism of the cutting device E.

Figure 8:
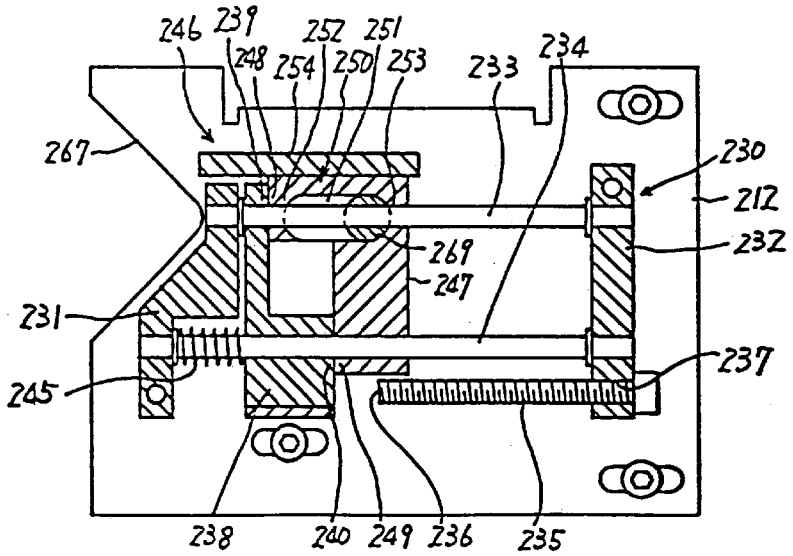
FIG. 8 is a section view of the positioning device and taken on the line VIII—VIII of FIG. 7.
Figure 10:
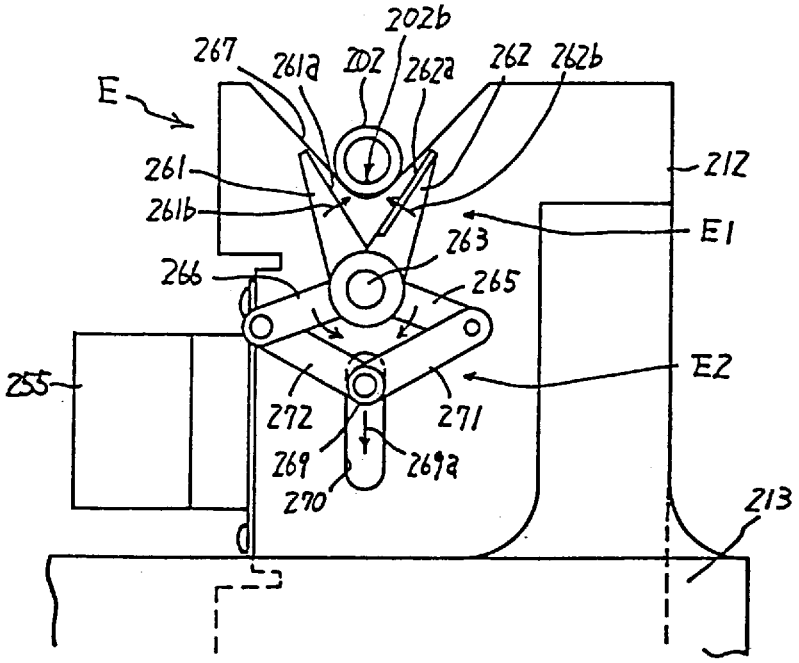
FIG. 10 is a bottom view of a cutting device.

Next, FIGS. 7 and 8 showing the cutting device E will be described. The cutting device E consists of a cutting mechanism E1, and a driving mechanism E2 for driving the mechanism. The cutting mechanism E1 cuts the thread positioned by the positioning device D while maintaining the positioned state. The configuration of the mechanism will be described. The reference numerals 261 and 262 designate a pair of cutting members, and 261*a* and 262*a* designate blades of the members. The reference numeral 263 designates a shaft member for pivotally attaching the cutting members 261 and 262 to the base plate 212. The shaft member is configured by a pin having the head 263*a* for preventing the cutting members from slipping off. The pair of cutting members 261 and 262 are pivotally attached by the shaft member 263 in such a manner that the blades 261*a* and 262*a* are slidingly contacted with each other. The reference numeral 264 designates a wave washer which causes the pair of cutting members 261 and 262 to exert a force for adequately making the blades 261*a* and 262*a* slidingly contacted with each other. The force is exerted through the head 263*a* by urging the shaft member 263 in the upward direction in FIG. 7. The reference numerals 265 and 266 designate levers which operate the cutting members 261 and 262, and are integrated with the cutting members 261 and 262, respectively. The reference numeral 267 designates a shielding member for, when the cutting device E is not operated, shielding the thread passage from the blades 261*a* and 262*a* of the pair of cutting members 261 and 262. As shown in FIG. 10, the member is disposed at a position where it overlaps with the cutting members 261 and 262 in the nonoperating state. The member 267 is disposed in order to, even when a thread passing the vicinity of the cutting members 261 and 262 during the stitching operation is laterally fluctuated as a result of an operation of the needle or the take-up device, prevent an accident in which the thread is erroneously contacted with the blades 261*a* and 262*a* and cut off, from occurring. An example in which the member 267 is configured by a part of the base plate 212 is shown. Alternatively, a member which is separately formed may be attached to the base plate at a position where the member overlaps with the cutting members 261 and 262.

Next, the driving mechanism E2 will be described. The reference numeral 269 designates a driving body which is reciprocally attached to the guiding rod 233 and positioned in the cutaway portion 251 of the operation block 247. The reference numeral 270 designates a guide hole which is opened in the base plate 212 in order to guide the movement of the driving body 269, and which is formed in parallel with the guiding rod 233. The reference numerals 271 and 272 designate coupling pieces for coupling the driving body 269 to the levers 265 and 266. One end of each piece is pivotally attached to the driving body 269. The other ends are pivotally attached to the levers 265 and 266, respectively.

In the cutting device E, when the operation block 247 is moved from the state of FIG. 5 and passes over that of FIG. 6A, the engaging portion 252 abuts against the driving body 269 and the driving body 269 starts to be moved with being integrated with the operation block 247. When the operation block 247 is further moved as shown in FIG. 6B, the driving body 269 is moved in the direction of an arrow 269*a* in FIG. 10. This movement causes the levers 265 and 266 to be respectively tilted in the directions of arrows via the coupling pieces 271 and 272, and the cutting members 261 and 262 to be respectively tilted in the directions of arrows 261*b* and 262*b*, with the result that the blades 261*a* and 262*a* meet and are slidingly contacted with each other. By contrast, when the operation block 247 is returned from the state of FIG. 6B to that of FIG. 6A and then operated, the engaging portion 253 abuts against the driving body 269 during the returning process, and thereafter the driving body 269 conducts the returning operation with being integrated with the operation block 247. When the operation block 247 is returned to the position of FIG. 5, the pair of cutting members 261 and 262 are returned to the state of FIG. 10. The positional relationship between the positioning device D and the cutting device E is set so that the meeting of the blades 261*a* and 262*a* is done at a position on the extension line 202*b*.

Figure 13A:
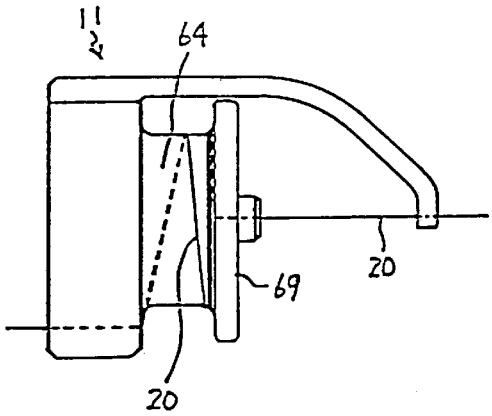
FIG. 13A is a side view showing a winding state of a thread in a retraction device in a preparation state.

In the configuration, the thread preparation work is conducted in the following manner. The threads 20 are pulled out from the plurality of bobbins 21, and the front ends of the threads are then individually inserted into the holding portion 35 from a number of inlets of the selection mechanism B, through the thread guide 81, the retraction device 11, the thread guide 84, etc. In this case, in the retraction device 11, the winding member 69 is manually rotated after the passing of the thread 20, whereby a predetermined amount of the thread 20 is wound on the drum 64 as shown in FIG. 13A. The wound amount is determined in the following manner. When an arbitrary thread is extracted in the manner described below by feeding out the thread 20 by means of the rotation of the winding member 69 in the feeding-out direction and the thread is passed to the stitching needle, the amount of the thread remaining to be wound on the drum 64 has a value (for example, one turn) suitable for applying an adequate tension on the thread 20 as described later. Therefore, the wound amount depends on the distance between the selection mechanism B and the needle. For example, the wound amount is about three and a half turns.

Next, the operation of extracting a thread which is arbitrarily selected from the multiple threads to the extraction place 208 will be described. This operation is conducted in three stages: a first stage of, in response to instructions from a control device (not shown) indicating that the thread 20 of a predetermined color is extracted, feeding out the thread from the outlet 34 of the selection mechanism B; a second stage of positioning the fed out thread by the positioning device D; and a third step of cutting the positioned thread by the cutting device E. These operations are conducting by operating the members as shown in the time chart of FIG. 12.

Figure 11A:
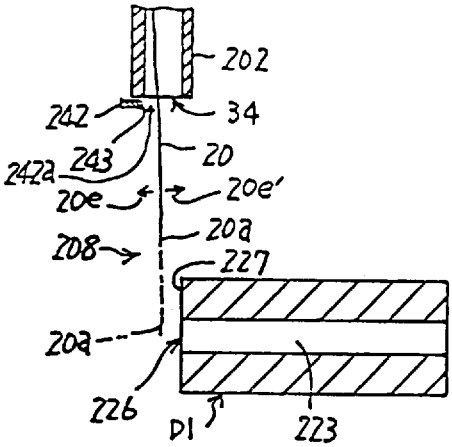
FIGS. 11A to 11E are section views illustrating an operation of positioning a thread.
Figure 11B:
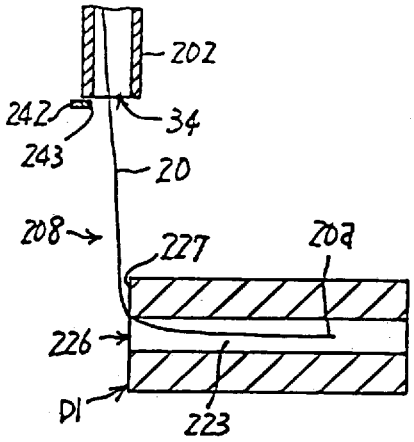
Figure 12:
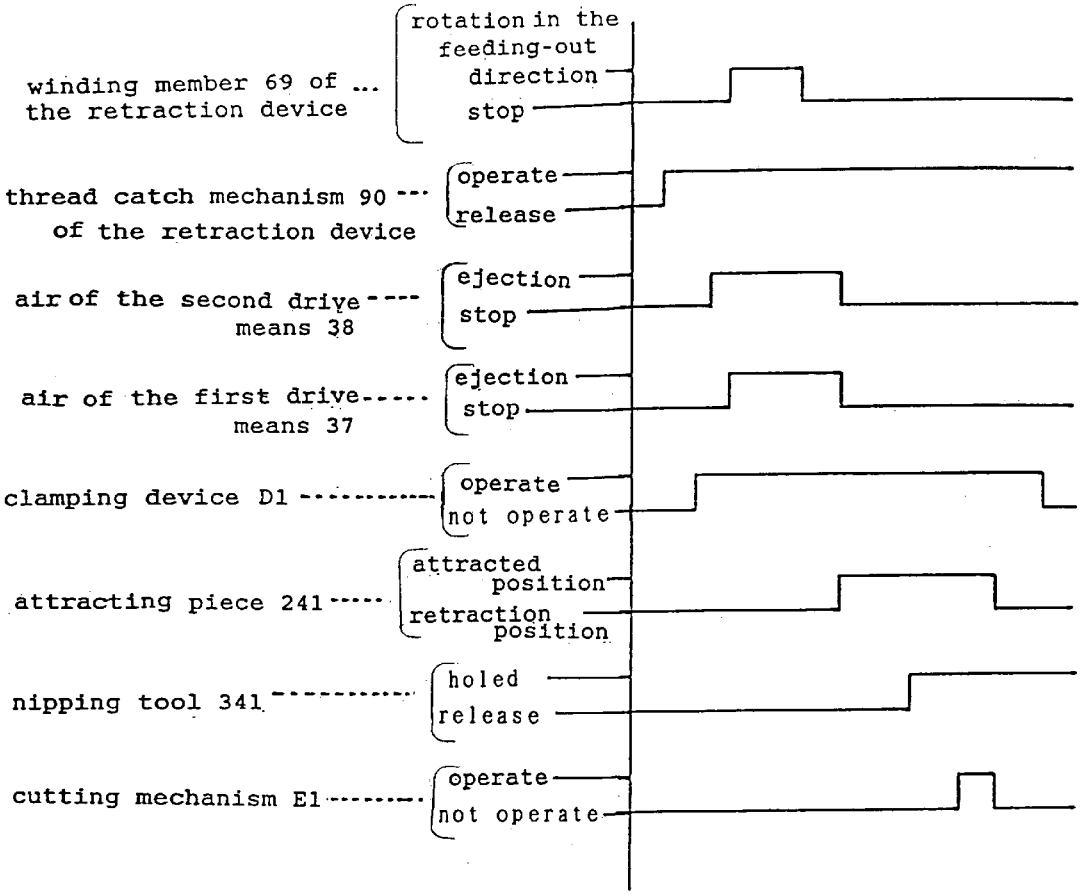
FIG. 12 is a time chart illustrating the operation of the thread selection device.

Initially, the first stage will be described. In response to the instructions, as shown in FIG. 12, the winding member 69 in the retraction device 11 relating to the selected predetermined thread is rotated in the direction in which the thread is fed out so as to conduct the operation of feeding out the thread 20. In the selection mechanism B, the air ejection of the first drive means 37 and that of the second drive means 38 are conducted as shown in FIG. 12. As a result, the selected thread 20 is fed out from the outlet 34 to the extraction place 208 as shown 11A. The fed out portion has a length at which the front end 20*a* of the thread 20 can reach the clamping device D1 as shown in FIG. 11B so as to be clamped by the device. The length control is done by controlling the rotation angle of the winding member 69 of the retraction device 11. The length is determined so that, when the cutting operation described below is done, a predetermined length of the thread remains on the side of the retraction device 11 (when the feeding-out operation for passing the thread to the needle is conducted as described below, the one turn of the thread remains on the drum 64.).

Figure 11C:
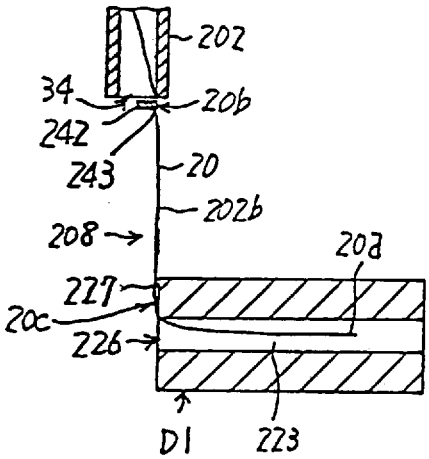
Figure 11D:
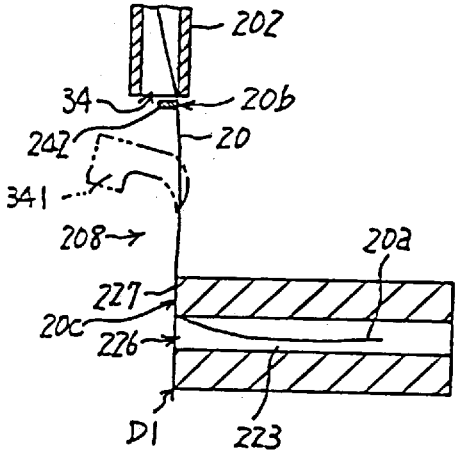
Figure 11E:
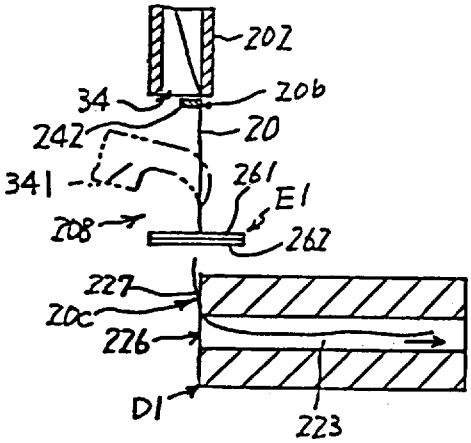

Next, the second stage will be described. Under the state where the thread 20 is fed from the outlet 34 to the extraction place 208 as described above, the thread 20 is already positioned in the thread passage 242*a* inside the surrounding wall 242. When the front end portion 20*a* of the fed-out thread 20 reaches the front of the suction port 226 of the clamping device D1 as indicated by the phantom line in FIG. 11A, it is pulled into the through hole 223 through the suction port 226 as shown in FIG. 11B. The air supply to the clamping device D1 is previously conducted as shown in FIG. 12 and the clamping device is already in the operating state. This pulling operation causes the thread 20 in the range from the retraction device 11 to the clamping device D1 via the selection mechanism B, to have a state where it is tightly stretched. The lower end portion of the thread abuts against the peripheral edge of the suction port 226 and its position is laterally restricted. When the attracting piece 241 is then operated, the surrounding wall 242 is moved as shown in FIG. 11C. The thread 20 in the extraction place 208 is attracted toward the right side of FIG. 11 under the state where the upper end portion 20*b* of the thread is surrounded by the surrounding wall 242, and then positioned by the V-like bottom portion of the attracting portion 243. The lower end portion 20*c* of the thread in the extraction place 208 abuts against the positioning portion 227, and positioned at a given position. As a result of the positioning operation described above, in the state of FIG. 11A, the thread 20 is in the state where it is positioned in a still state along the extension line 202*b* as shown in FIG. 11C, even when the thread 20 is fanned by the air ejected from the outlet 34 and laterally fluctuated as indicated by the arrows 20*e* and 20*e*'. Consequently, the horizontal position of the thread 20 is determined. When an arbitrary nipping tool 341 (for example, a nipping tool for conducting a mechanical operation of bringing the thread 20 to the position of the needle) which is an example of a reception port for a device of the succeeding stage is brought to the extraction place 208 as shown in FIG. 11D, therefore, the thread can be nipped in a uniform and adequate state.

In the third stage, the cutting mechanism E1 is operated under the state where the thread 20 is stretched and positioned as shown in FIG. 1E, and the thread 20 is cut off by the pair of cutting elements 261 and 262. In this case, both the cutting elements 261 and 262 conduct an operation in which the respective blades 261*a* and 262*a* symmetrically advance toward the thread 20 in the positioned state. The blades 261*a* and 262*a* meet at the position of the positioned thread 20 and cut the thread 20 existing there. After the cutting operation, the advance of the blades 261*a* and 262*a* stops at a place where the blades slightly cross each other, and the blades are then returned to their original positions. The thread 20 which has been cut off as a result of the cutting operation is transported by the air flow of the clamping device D2 to an accumulation place which is not shown, via the through hole 223, the discharge port 219, and the hose 220.

In the cutting operation, since the thread 20 is cut off under a state where it is stretched, the thread can be surely cut off. Since the thread 20 is cut off with maintaining its positioned state, the cutting operation can be conducted without laterally bending the thread 20 existing in the extraction place 208. In other words, the front end of the thread 20 remaining in the extraction place 208 after the cutting operation can be kept straight. This enables the operations in the case where the thread 20 is fed to the succeeding mechanism ranging to the needle (for example, in the case where the thread is passed through the thread eye), to be conducted smoothly and surely. Furthermore, this facilitates the automatization of the operations. Since the cut-off thread 20 is carried away, moreover, it does not fall on the cloth which is currently subjected to the stitching operation. Therefore, it is possible to prevent an accident that a dropped thread is erroneously stitched, from occurring.

Figure 13B:
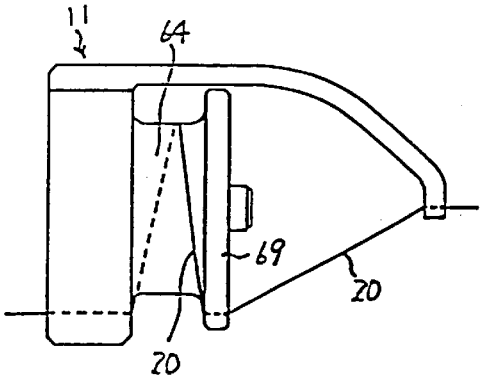
FIG. 13B is a side view showing a winding state of a thread in the retraction device in a stitching operation.

The thus extracted thread 20 is passed to the thread eye of the needle by the known thread passing device, or by a pulling-down device F and a thread passing, device G which will be described below. In this case, in the retraction device 11, the winding member 69 is rotated in the thread feeding-out direction so that the thread wound on the drum 64 is fed out. As a result of the feeding-out operation, under a state where the thread is passed through the thread eye of the needle, for example, the above-mentioned one turn of the thread 20 remains on the periphery of the drum 64 as shown in FIG. 13B.

F shown in FIGS. 1 and 2 designates means for nipping the thread 20 which has been selected by the selection device A and extracted to the extraction place 208, at the place, and for bringing the thread to the needle 6. In the embodiment, F designates the pulling-down device for pulling down the nipped thread to the needle 6 at a lower position. When the device F is lowered to a place in the vicinity of the needle 6, the device functions as the passing device for passing the front end portion of the received thread 20 through the thread eye of the needle 6. G designates the thread passing device for further pulling the thread 20 the front end of which is passed through the needle 6, thereby causing the thread 20 to be sufficiently passed through the thread eye of the needle 6.

First, the pulling-down device F will be described The device F comprises an arm F1 in which one end is pivotally attached and the other end is vertically movable, a driving mechanism F2 for vertically driving the arm F1, and a catch device F3 which is disposed at the free end of the arm F1 and used for catching the thread. Hereinafter, each of these components will be described.

Figure 20:
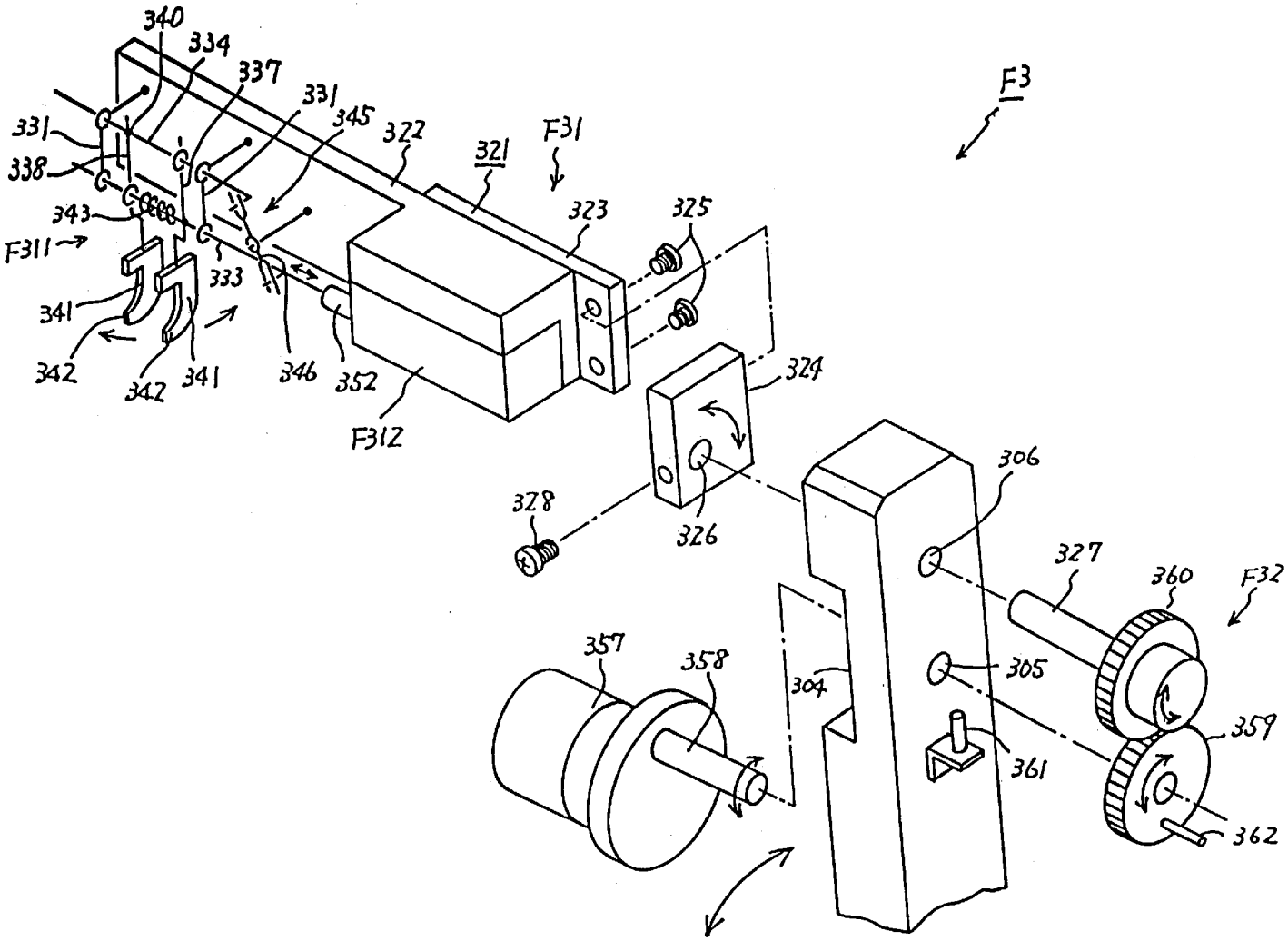
FIG. 20 is an exploded perspective view of the catch device.

The arm F1 will be described with reference to FIGS. 1 to 17 and 20. In order to attain a quick movement, the arm F1 is formed by a light weight material such as aluminum. The length is determined so that, when the arm F1 is tilted under the state where one end is pivotally attached to the head frame 4, the other end reaches the side position of the extraction place 208 and that of the needle 6. The one end portion of the arm F1 is pivotally supported at a position higher than the needle 6. For example, at the position of a through hole 301 for pivotal support and formed at one end of the arm F1, the arm is pivotally attached to the head frame 4 by a pin 302 which is an example of a pivotally attaching member. The pivotal support portion is set to be a position higher than the needle 6, in order that the other end portion of the arm F1 at the position of the needle 6 has a larger horizontal movement component. The reference numeral 303 designates a driven portion for receiving the drive of the driving mechanism F2. An oblong hole is shown as an example of the driven portion. The reference numerals 304 to 306 shown in FIG. 20 designate members for attaching the catch device F3, 304 designates a recess for mounting a motor, 305 designates a through hole through which the motor shaft is to be passed, and 306 designates a bearing hole for rotatably supporting an attaching shaft. The reference numeral 307 shown in FIG. 2 designates a recess for preventing interference between the arm and the main shaft 308 of the sewing machine from occurring.

As the driving mechanism F2, various kinds of mechanisms such as that using a fluid cylinder as a driving source, or that using an electric motor as a driving source may be used. Among such mechanisms, a mechanism configured by members designated by reference numerals 310 to 319 is used as an example. The reference numeral 310 designates a base for supporting members of the mechanism F2. The base is attached to the frame 1. The reference numeral 311 designates a linear reciprocating mechanism disposed on the base 310, 312 designates a pair of supporting bodies which are attached to the base 310, 313 designates a pair of guiding rods which are attached to the supporting bodies 312, and 314 designates a feeding rod which is configured by a threaded rod and rotatably attached to the supporting bodies 312. The reference numeral 315 designates a reciprocating block which is an example of a driving element for driving the arm F1. The reference numeral 315*a* designates through holes through which the guiding rods 313 are to be passed, and 315*b* designates a threaded hole into which the feeding rod 314 is to be screwed, and which is guided along the guiding rods 313 passed through the through holes 315*a* by the rotation of the feeding rod 314 screwed into the hole, thereby performing a linear motion. The reference numeral 316 designates a coupling piece which is disposed on the reciprocating block 315 and in the oblong hole 303, 317 designates a driving motor attached to the base 310, 318 designates a pinion attached to the rotation shaft of the motor 317, and 319 designates a gear which is attached to the feeding rod 314 and meshes with the pinion 318. In the thus configured driving mechanism F2, when the motor 317 operates, the feeding rod 314 is caused to rotate through the pinion 318 and the gear 319, the reciprocating block 315 performs a linear motion, and the coupling piece 316 is moved in the direction of an arrow 316*a* of FIG. 16, thereby tilting the arm F1 in the direction of an arrow F1*a*.

FIGS. 18 to 21 showing the catch device F3 will be described. The device F3 is configured by a catch mechanism F31 which nips and catches a thread, and a direction change mechanism F32 which changes the direction of the catch mechanism F31 for the operation of nipping the thread, retraction from the thread passing place, and the operation of passing the thread through the thread eye of the needle. First, the catch mechanism F31 will be described. The mechanism F31 is configured so as to mechanically nip and hold a thread, and disposed on the free end portion of the arm F1 so that, when the arm F1 is vertically moved, the mechanism can be moved between the thread extraction place 208 of the selection device A and a position opposing the thread eye 6*a* of the needle 6. The direction of the mechanism can be changed also in a vertical plane. The configuration will be described. The catch mechanism F31 is configured by a base 321, a nipping mechanism F311 disposed on the base 321, and a driving device F321 for operating the nipping mechanism F311. First, the base 321 will be described. The base 321 supports various members of the mechanism F31, and is configured by the base body 322 and attachment members 323 and 324. The reference numeral 325 designates set screws for integrating the attachment members 323 and 324 with each other, 326 designates an attachment hole for attaching the member 324 to an attachment shaft 327, and 327 designates the attachment shaft for pivotally attaching the base 321 to the free end portion of the arm F1. These members are configured so that the shaft 327 is rotatable passed through the bearing hole 306, and the front end portion of the shaft is inserted into the attachment hole 326 and fixed by a set screw 328, whereby the base 321 is rotatably attached to the arm F1.

Figure 32:
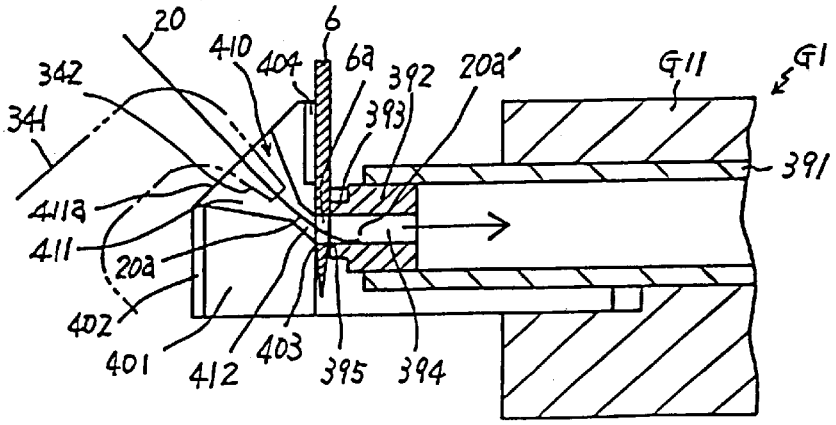
FIG. 32 is a longitudinal section view showing a state where the front end portion of the thread is passed through the thread eye.

Next, F311 designates the nipping mechanism which is disposed on the base 321 and configured by members designated by reference numerals 331 to 343 and a mechanism 345. Each of these members will be described. The reference numeral 331 designates a pair of supporting bodies each of which has a pair of guide holes 332 and is attached to the base body 322. The reference numerals 333 and 334 designate a pair of reciprocating rods for supporting a pair of reciprocating members. The reciprocating rods are passed through the guide holes 332 so as to be reciprocally movable. The reciprocating rod 333 functions also as a driven member which is driven by the driving device described below. The reference numeral 335 shown in the right end of FIG. 18 designates a driven portion which receives the driving force. The reference numeral 336 designates a separation preventing piece which prevents separation due to a lateral displacement between the driven portion and the driving portion from occurring. The reference numerals 337 and 338 designate a pair of reciprocating members each of which has a pair of through holes 339 for passing the reciprocating rods. The reference numeral 340 designates securing members for securing the reciprocating members to the reciprocating rods. For example, setting screws are used as the securing members. The reciprocating rods 333 and 334 are passed through the through holes 339 of the reciprocating members 337 and 338. The reciprocating member 337 is secured to the reciprocating rod 333, and the reciprocating member 338 to the reciprocating rod 334. The reference numeral 341 designates nipping pieces which are respectively disposed on the reciprocating members 337 and 338 and have at the front end portion a nipping portion 342 which is curved and tapered or has a tweezer-like shape so as to enter a guide hole 410 of a thread passing mechanism G1 as shown in FIG. 32. As illustrated, the nipping pieces 341 are projected from edge portions of 337*a* and 338*a* of the opposing sides of the reciprocating members 337 and 338 so that, when the pieces approach each other, the nipping portions 342 overlap with each other. The reference numeral 343 designates a spring for separating the pair of nipping pieces 341 from each other. As the spring, a compression spring interposed between the reciprocating members 337 and 338 is used.

The reference numeral 345 designates an interlock mechanism for causing the pair of reciprocating members 337 and 338 to symmetrically operate or interlocking the pair of reciprocating rods 333 and 334. Specifically, 346 designates an interlock lever which is pivotally attached to the base body 322 by a pin 347 which is an example of a pivotally attaching piece, at a position which is at exactly the midpoint between the reciprocating rods 333 and 334. A fitting recess 348 is formed in each of the ends, and interlocking pieces 349 fixed to the reciprocating rods 333 and 334 are fitted into the recesses.

In the thus configured nipping mechanism F311, when one of the reciprocating rods or the reciprocating rod 333 is reciprocated, the other reciprocating rod or the reciprocating rod 334 is symmetrically reciprocated, with the result that the pair of reciprocating members 337 and 338 symmetrically conduct the approaching and withdrawing operations. As a result, the pair of nipping pieces 341 overlap with each other at exactly the midpoint 350 between the pieces. The midpoint 350 coincides with the thread positioning position of the positioning device D of the thread end process mechanism C.

Next, F312 designates a driving device which drives the nipping mechanism F311. As an example of the device, a solenoid in which a driving piece 352 is reciprocated in accordance with energization and deenergization is used. The reference numeral 353 designates a driving portion for operating the driven portion 335 of the nipping mechanism F311. For example, the driving portion is configured by the front end portion of the driving piece 352 and pushingly drives the driven portion 335. The reference numeral 354 designates a lateral-displacement preventing portion for preventing the driven portion 335 of the mechanism F311 from being displaced with respect to the driving portion 353. As an example of the portion, a recess into which the separation preventing piece 336 is fitted is used.

Figure 22A:
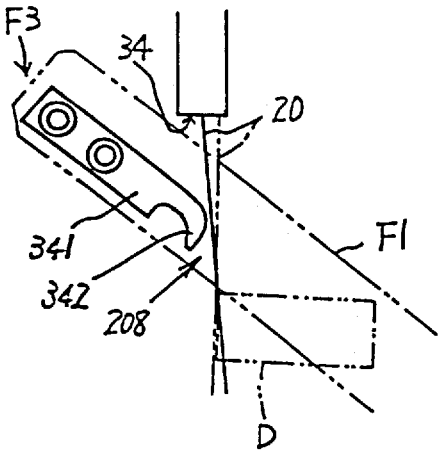
FIGS. 22A to 22D are views illustrating an operation of pulling down a thread.
Figure 22B:
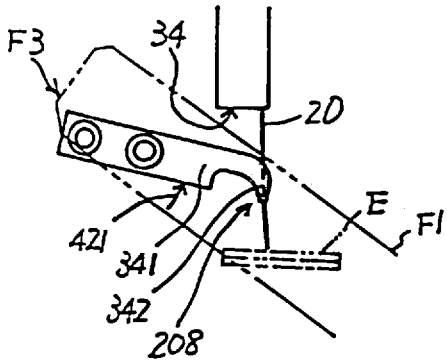

The direction change mechanism F32 is configured by members designated by reference numerals 357 to 362. Each of these members will be described. The reference numeral 357 designates a driving motor. Because of excellent controllability of the rotation angle, for example, a pulse motor is used. The reference numeral 358 designates the rotation shaft of the motor, 359 and 360 designate a pair of gears which are used as examples of a member of coupling the motor rotation shaft 358 of the motor with the attachment shaft 327 of the catch mechanism F31, 361 designates a stopper attached to the arm F1, and 362 designates an abutment piece attached to the gear 359. Under the state where the gear 359 is rotated to a predetermined position, the piece abuts against the stopper 361 so that the rotation of the gear 359 is stopped. The stop position will be described later. In the direction change mechanism F32, the attachment shaft 327 of the catch mechanism F31 is caused to rotate through the gears 359 and 360 by the rotation of the motor 357, and the nipping pieces 341 are changed in direction as shown in FIG. 22A or 22B.

Next, the thread passing device G will be described. The device G comprises the thread passing mechanism G1 for conducting the operation of passing the thread 20 through the needle 6, a supporting mechanism G2 for supporting the thread passing mechanism so as to be reciprocally movable between a retraction position G1A and a thread passing position G1B, and a driving mechanism G3 for moving the thread passing mechanism G1 between the two positions. The retraction position G1A is set to be a position which is higher than the thread passing position G1B, in order to ensure a working space which is as high as possible, between the bed and the thread passing mechanism G1 during the stitching operation. In the case where embroidery is performed on a cloth stretched on a taboret while the taboret is moved along the upper face of the bed, such a high working space can prevent the taboret or a clip for fastening the cloth to the taboret from interfering with the guiding means G14, thereby enabling the embroidery work to be smoothly conducted.

Figure 23:
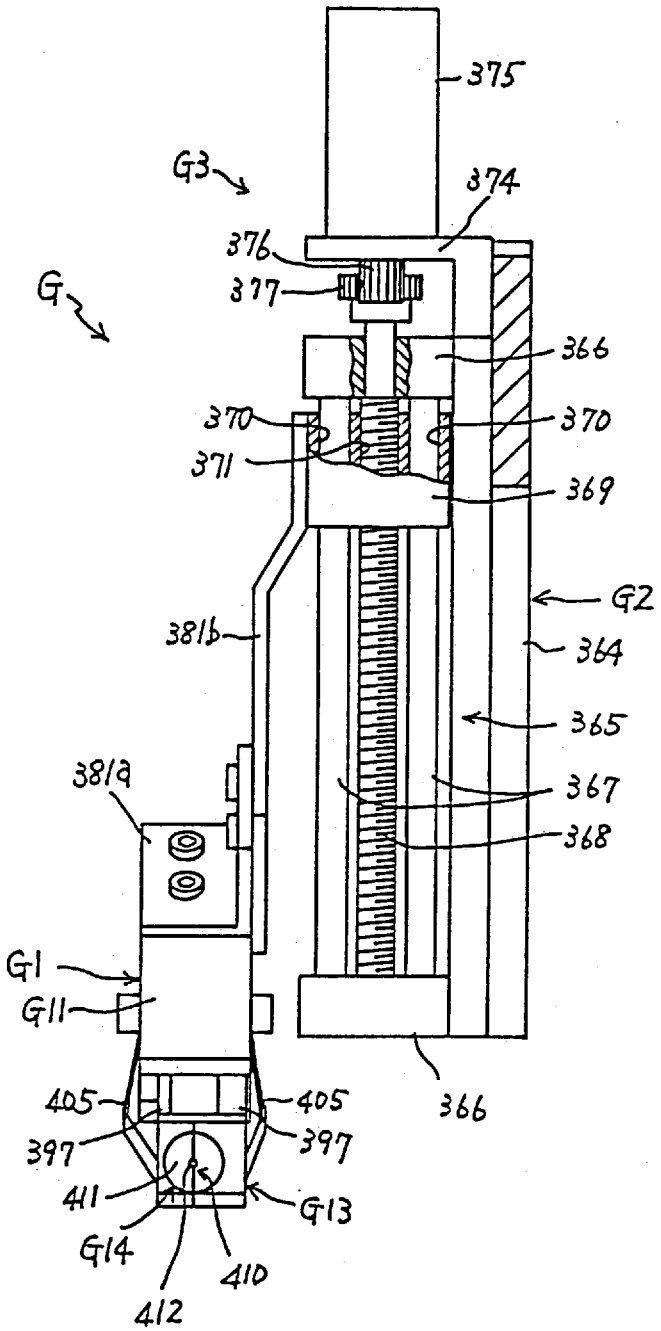
FIG. 23 is a cutaway section view with partially cut away, and showing a needle thread passing device as seen in the direction of the arrow XXIII of FIG. 2.
Figure 24:
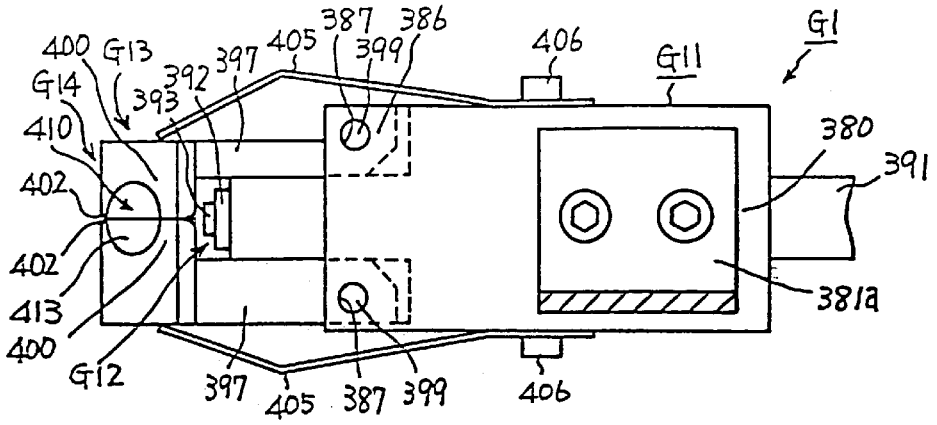
FIG. 24 is a plan view of a thread passing mechanism.

First, FIGS. 2 and 23 showing the supporting mechanism G2 will be described. The mechanism G2 is configured by members designated by reference numerals 364 to 371. The reference numeral 364 designates a base which is formed into an L-like arm as shown in FIG. 2 and attached to the head frame 4. The reference numeral 365 designates a linear reciprocating mechanism provided to the base 364, which is used for supporting the thread passing mechanism G1 so as to be linearly movable between the two positions, and which is configured in the same manner as the linear reciprocating mechanism 311. Specifically, 366 designates a pair of supporting bodies, 367 designates a pair of guiding rods, 368 designates a feeding rod, 369 designates a reciprocating block, 370 designates a through hole, and 371 designates a threaded hole.

The driving mechanism G3 is configured so as to rotate the feeding rod 368 and consists of members designated by reference numerals 375 to 377. The reference numeral 375 designates a driving motor attached to the base 364 through a bracket 374, 376 designates a pinion attached to a rotation shaft of the motor 375, and 377 designates a gear which is attached to the feeding rod 368 and meshes with the pinion 376.

The thread passing mechanism G1 will be described with reference to FIGS. 23 to 27. The mechanism G1 consists of a frame G11 for supporting the following means and mechanism, passing means G12 for passing a thread through the thread eye of the needle 6 by means of a suction force of air, a holding mechanism G13 for holding the thread passed through the thread eye of the needle 6 while maintaining the passed state, and guiding means G14 for, when the thread is to be passed through the thread eye of the needle 6, positioning the thread along the front face of the needle 6 in order to guide the thread toward the thread eye. The front of the needle 6 means the left side of the needle 6 (the side of the front of the sewing machine) in FIG. 2, and the rear means the right side (the side of the rear of the sewing machine).

First, the frame G11 will be described. The frame G11 is made of, for example, a metal material and has a structure designated by reference numerals 380 to 388. The reference numeral 380 designates an attaching portion for attaching the frame G11 to the reciprocating block 369, 381*a* and 381*b* designate brackets for attachment, and 383 designates a through hole which is an example of a mounting portion for the passing means G12. The reference numeral 384 designates a mounting portion for the holding mechanism G13. The reference numeral 385 designates a portion for holding a basal portion of a clamping arm of the mechanism G13. The portion is configured as a recess and comprises overhang portions 386 for supporting the arms in the upper and lower regions. The reference numeral 387 designates a through hole for pivotal support, and 388 designates threaded holes for attaching urging springs of the mechanism G13.

The passing means G12 has a configuration designated by reference numerals 391 to 395. Each of the members will be described. The reference numeral 391 designates a suction pipe mounted to the through hole 383, and 392 designates a suction nozzle which is made of a material having flexibility and elasticity in order to attain airtight close contact with respect to the needle 6, such as a rubber material. The nozzle is bonded to one end of the pipe 391 for the purpose of airtight attachment. The reference numeral 393 designates an abutting portion for the needle 6. In order to improve the airtight close contact, the portion has a small diameter as illustrated so as to facilitate elastic deformation. The reference numeral 394 designates a suction hole. One opening of the hole which opens on the abutting portion 393 serves as a suction port 395. The other end of the pipe 391 is connected to a suction device which is not shown.

Figure 28A:
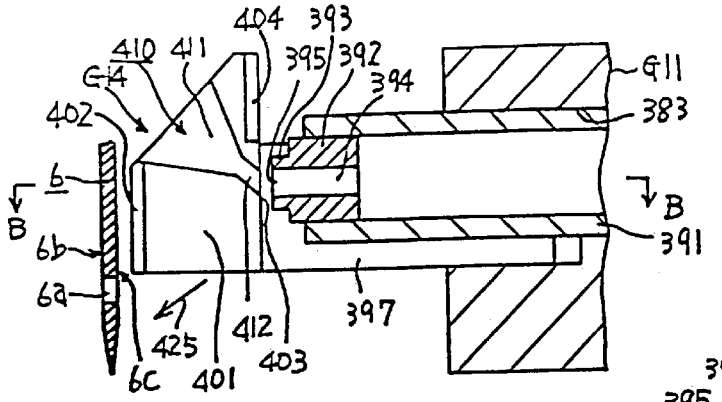
FIG. 28A is a longitudinal section view illustrating the loading of the thread passing mechanism to a needle, and showing a state where the thread passing mechanism approaches the needle.
Figure 28B:
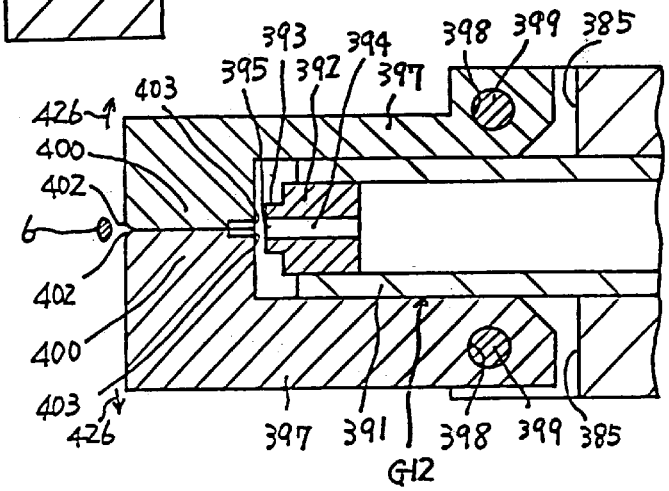
FIG. 28B is a horizontal section view taken at the position B—B of FIG. 28A.
Figure 29A:
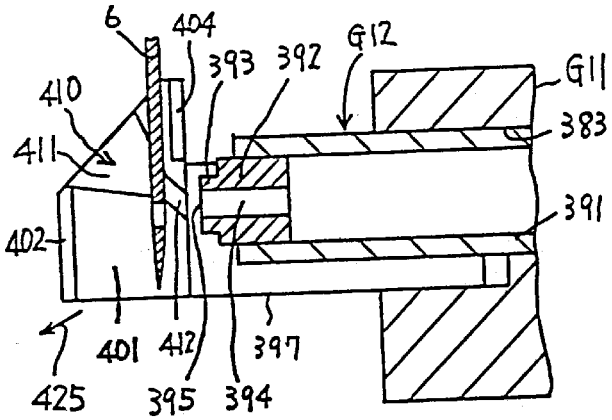
FIG. 29A is a longitudinal section view illustrating the loading of the thread passing mechanism to the needle, and showing a state where the needle enters a gap between clamping faces.
Figure 29B:
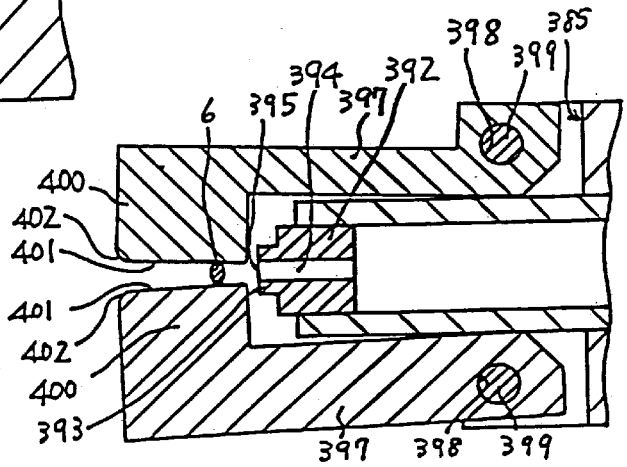
FIG. 29B is a horizontal section view showing the state of FIG. 29A and taken at the same position as that of FIG. 28B.

The holding mechanism G13 has a configuration designated by reference numerals 397 to 406. Each of the members will be described. The reference numeral 397 designates a pair of clamping arms which are made of a hard material (for example, a metal), and 398 designates through holes for pivotal attachment and formed in basal portions of the arms 397. The basal portions of the arms 397 are pivotally attached to the frame G11 at positions laterally separated from an axis 395*a* of the suction port 395, by pins 399 passing through the through holes 398 and 387. A small gap is formed between the basal portion of each of the arms 397 and the pipe 391 so that the arms 397 can be opened and closed as shown in FIGS. 29B and 28B. The reference numeral 400 designates overhang portions of the arms 397 which are stretched toward the opposing sides of the pair of arms 397 as illustrated, and 401 designates clamping faces for clamping a thread. The clamping faces are configured by the opposing faces of the overhang portions 400. The arms 397 have a positional relationship in which the clamping faces 401 perfectly overlap with each other on the axis 395*a* of the suction port 395. The reference numeral 402 designates front edges of the clamping faces 401 which serve as guide faces for introducing the needle 6 to the clamping faces 401. As an example of a slant face for guiding, each guiding face is formed as an arcuate face of a small diameter of, for example, 1 mm. The reference numeral 403 designates a holding portion for the needle 6 which is configured by flat faces of the overhang portions 400, and directed toward the nozzle member 392, and 404 designates a cutaway portion which is formed in order to prevent the mechanism from abutting against the needle 6. The cutaway portion is disposed in order to surely make the peripheral portion of a delivery portion 412 (which will be described later) abut against the needle 6 in the holding portions 403 (the abutting area is restricted to a narrow area in the periphery of the passing port). The surface of the cutaway portion is formed as an arcuate face of a small diameter. The reference numeral 405 designates plate springs which are an example of an urging member for urging the arms 397 so that the clamping faces 401 are pressingly contacted with each other. The springs are attached to the frame G11 by small screws 406 screwed into the threaded holes 388.

Figure 25:
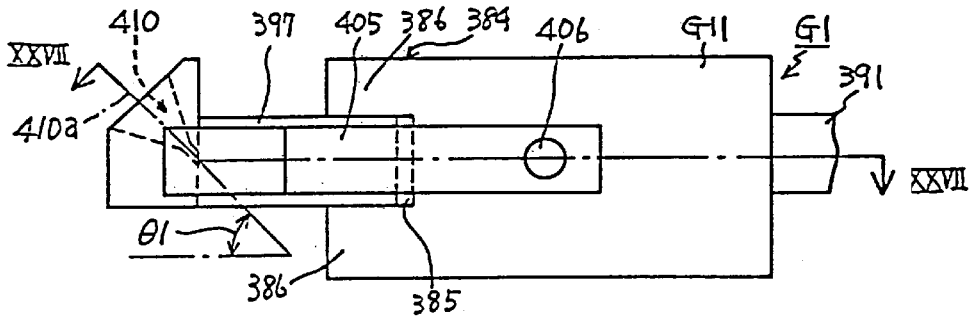
FIG. 25 is a side view of the thread passing mechanism.
Figure 26:
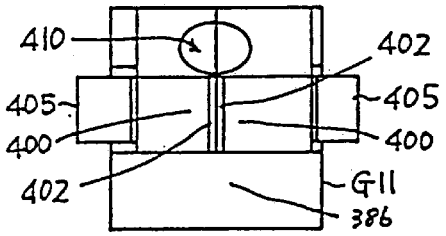
FIG. 26 is a front view of the thread passing mechanism.
Figure 27:
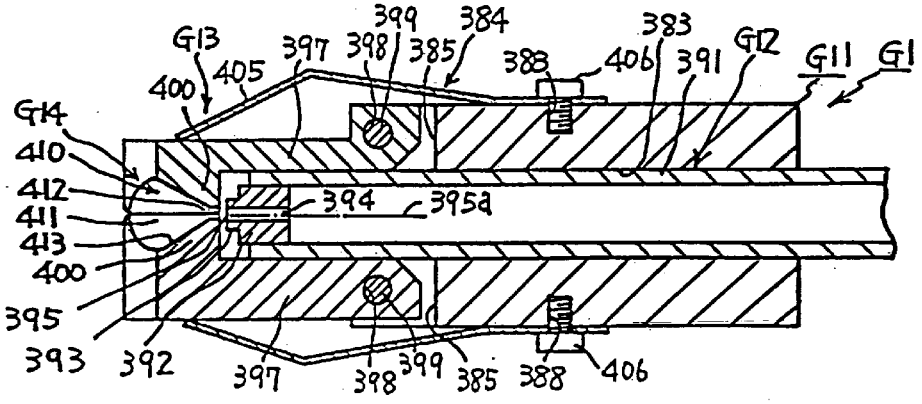
FIG. 27 is a section view taken on the line XXVII—XXVII of FIG. 25.

Next, the guiding means G14 will be described. The guiding means G14 is configured by a pair of members which can be laterally split from each other so that the needle 6 can pass through the gap between the pair of members. As the pair of members, for example, a part of the overhang portion 400 of each of the paired clamping arms 397 is used, and the clamping faces 401 of the overhang portions 400 function as the split faces of the pair of members. The guiding means G14 has a configuration designated by reference numerals 410 to 413. Each of the members will be described. The reference numeral 410 designates a thread guide hole which is configured so that an axis 410*a* is inclined by an angle θ1 with respect to a horizontal plane as shown in FIG. 25. The direction of the axis 410*a* coincides with the traveling direction of the thread pulled down by the pulling-down device F. For example, the angle θ1 is 45°. Since the pulling-down device F conducts the pulling-down operation by means of the rotation of the arm F1, the traveling direction of the thread coincides with a tangential direction of the arcuate movement locus of the free end portion of the arm F1 in the vicinity of the needle 6. The reference numeral 411 designates a guide portion of the guide hole 410 which guides the front end portion 20*a* of the thread 20 and the air flow so as to approach the axis 410*a*. As illustrated, the guide portion is formed into a funnel-like shape, and the inner face 413 serves as a guide face for guiding the thread and is formed into a smooth surface of, for example, a conical shape. The reference numeral 412 designates the delivery portion for delivering the front end portion 20*a* and the air flow approaching the axis 410*a*, along the axis 410*a* in the guide hole 410, thereby communicating with the thread eye 6*a*. In order to smoothly transfer the thread which has passed the portion to the thread eye 6*a*, the portion has a small diameter corresponding to the thread eye 6*a*, or, for example, equal to that of the thread eye. The delivery portion 412 and the suction port 395 are set so as to have a positional relationship in which they oppose each other.

The thread passing mechanism G1 comprising the above-mentioned means and mechanisms G12 to G14 is supported by the supporting mechanism G2, and is reciprocated between the retraction position G1A and the thread passing position G1B under the state where the stitching needle moves between the split faces 401 and 401 of the two members 400 and 400 in the guiding means G14.

Next, 416 shown in FIG. 2 designates a well-known needle bar driving mechanism for vertically driving the needle bar 5. The vertical driving of the needle bar 5 is conducted by an elevating body 418 which can be vertically moved along a guiding rod 417 by a driving device which is not shown.

Next, the operation of passing the thread through the needle 6 which is conducted by the pulling-down device F and the thread passing device G will be described. The thread passing is conducted under the state where the needle 6 is positioned at the top dead center and the vertical movement of the needle is stopped. The thread passing operation comprises a first step of catching the thread which is selected and extracted by the thread selection device A, a second step of pulling down the caught thread to the vicinity of the needle 6, and a third step of passing the pulled-down thread through the thread eye of the needle 6.

Figure 21A:
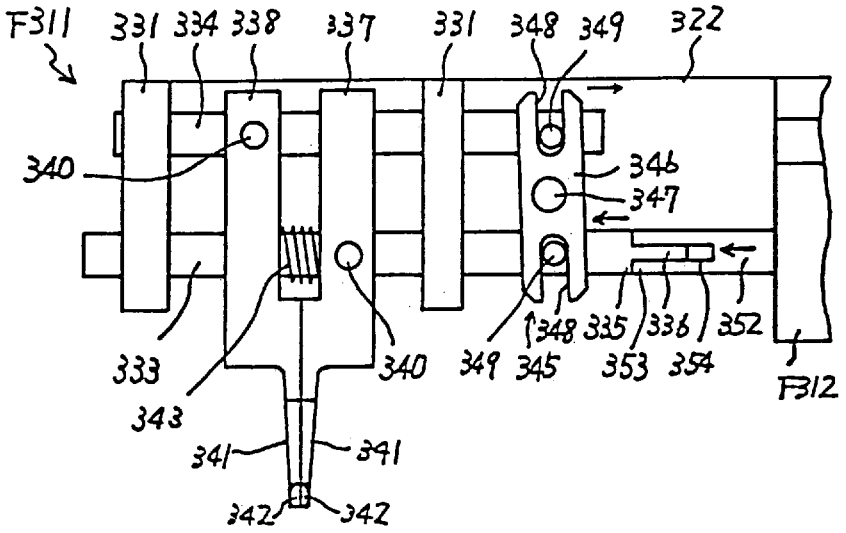
FIGS. 21A and 21B are views illustrating the operation of the nipping mechanism.
Figure 22C:
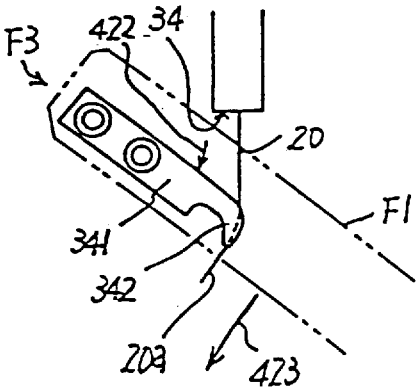

The first step will be described. Initially, as shown in FIG. 22A, the arm F1 is at the elevated position and the nipping pieces 341 are at a preparation position. The elevated position of the arm F1 is determined so as to be a given position by the positioning mechanism which is not shown in the figure. As the positioning mechanism, a mechanism is used in which the elevation of the reciprocating block 315 of the driving mechanism F2 to a predetermined position is detected and the operation of the motor 317 is then stopped. Alternatively, the position of the arm F1 may be directly detected and the operation of the motor 317 may be then stopped, or, in the case where, for example, an air cylinder is used as the driving mechanism F2, the arm F1 may be stopped by a mechanical stopper. Under the above-mentioned state, the thread 20 is fed out from the outlet 34 of the thread selection device A to the extraction place 208, and the thread 20 is positioned to a predetermined position as shown by the two-dot chain line by the positioning mechanism D of the thread end process mechanism C. In the above-mentioned case, the preparation position of the nipping pieces 341 is attained, for example, by causing the abutment piece 362 of the direction change mechanism F32 to abut against the stopper 361. Thereafter, the catch mechanism F31 is rotated by the direction change mechanism F32, and the nipping pieces 341 move in the direction of an arrow 421 to enter the extraction place 208 as shown in FIG. 22B. For example, this operation is conducted by sending a predetermined number of pulses to the driving motor 357, thereby rotating the rotation shaft 358 by a predetermined angle. Then, the nipping mechanism F311 is driven by the driving device F312, and the nipping pieces 341 are closed as shown in FIG. 21A so as to nip the positioned thread 20. Next, the cutting device E of the thread end process mechanism C is operated and the unnecessary part which is the front end portion of the nipped thread 20 is cut off. As a result of this cutting, the front end of the thread nipped by the nipping portions 342 is projected from the nipping portions 342 by, for example, about 5 to 6 mm. Thereafter, the catch mechanism F31 is rotated by the direction change mechanism F32 in the direction opposite to that of the above-mentioned rotation, and the nipping pieces 341 move in the direction of an arrow 422 to reach the passing position as shown in FIG. 22C. The passing position is a position for the work in which the front end of the thread 20 is passed through the thread eye of the needle as described below. In the embodiment, an example in which the passing position is identical with the preparation position is shown. In the embodiment, in the same manner as the preparation position, the passing position is attained by causing the abutment piece 362 to abut against the stopper 361.

Figure 22D:
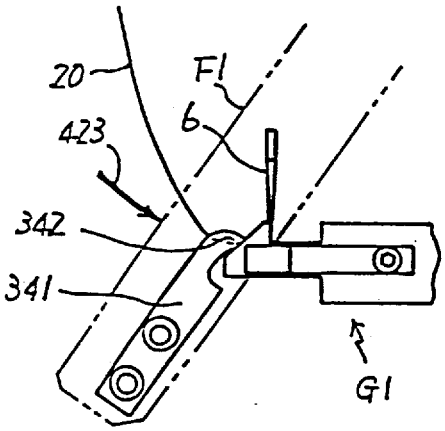

The second step will be described. This step is conducted by the driving mechanism F2 so as to downwardly swing the arm F1 from the state of FIG. 22C as indicated by an arrow 423 and bring the arm to the lowered position as shown in FIG. 22D. As a result of this swing of the arm F1, the front end portion of the thread 20 which is mechanically nipped by the nipping pieces 341 is pulled down from the thread selection device A to reach the thread passing mechanism G1. The operation of positioning the arm F1 at the lowered position is conducted in the same manner as that at the elevated position.

The third step will be described. The third step comprises a preparation process of loading the thread passing mechanism G1 to the needle 6 in order to conduct thread passing, a passing first process of passing the front end portion of the thread through the thread eye of the needle 6, a passing second process of further deeply passing the thread the front end portion of which has been passed through the thread eye, and a releasing process of, after the passing is completed, separating the thread passing device G from the needle 6.

Figure 30:
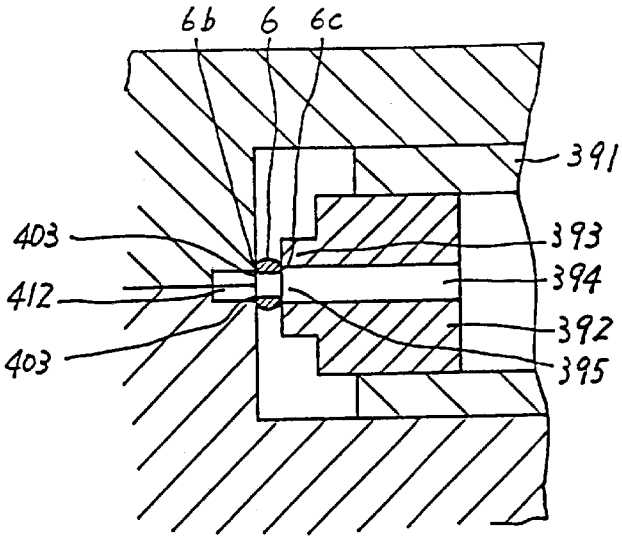
FIG. 30 is a horizontal section view of the main portions in a state where the thread passing mechanism is loaded to the needle.

The preparation process will be described. This process is conducted by moving the thread passing mechanism G1 from the retraction position G1A shown in FIG. 2 to the thread passing position G1B by the driving mechanism G3. Hereinafter, this process will be described. In the positioning of the thread passing mechanism G1 at the retraction position G1A or the thread passing position G1B, it is detected that the reciprocating block 369 is moved to the predetermined position corresponding to the position G1A or G1B, and the operation of the motor 375 is then stopped. Alternatively, the position of the frame G11 of the thread passing mechanism G1 may be directly detected and the operation of the motor 375 may be then stopped. First, the thread passing mechanism G1 is moved in the direction of an arrow 425 by the driving mechanism G3. As a result of this movement, the thread passing mechanism G1 advances toward the needle 6 as indicated by the arrow 425 in FIG. 28. When the guide faces 402 abut against the needle 6, the pair of arms 397 are pushed and opened in the direction of arrows 426 with being guided by the guide faces 402. As the movement in the direction of the arrow 425 advances, the needle 6 relatively enters the gap between the pair of the clamping faces 401 as shown in FIG. 29. When the movement in the direction of the arrow 425 further advances and the needle 6 is passed through the gap between the clamping faces 401, as shown in FIG. 30, the gap between the clamping faces 401 is closed by the urging forces of the springs 405 shown in FIGS. 24 to 27, and the holding portions 403 abut against a face 6*b* in the front side (also called as a surface side) of the needle 6. The abutting portion 393 of the suction nozzle 392 is elastically deformed by the abutment against a face 6*c* in the rear side (also called as a back side) of the needle 6, and closely contacted with the face, so that the suction port 395 communicates with the thread eye 6*a* of the needle 6. In this case, the holding portions 403 which abut against the front face 6*b* of the needle 6 hold the needle 6 and maintain the close contact state of the abutting portion 393 to the rear face 6*c* of the needle. During the process, for example, during a period between the start of the advance of the thread passing mechanism G1 and the abutment of the guide faces 402 against the needle 6, the operation of the suction device is started and the air suction from the suction port 395 is started. The preparation process is conducted in parallel with the second step, and completed before the thread 20 is pulled down to the vicinity of the needle 6. Alternatively, the preparation process may be conducted in parallel with the first step.

Figure 31:
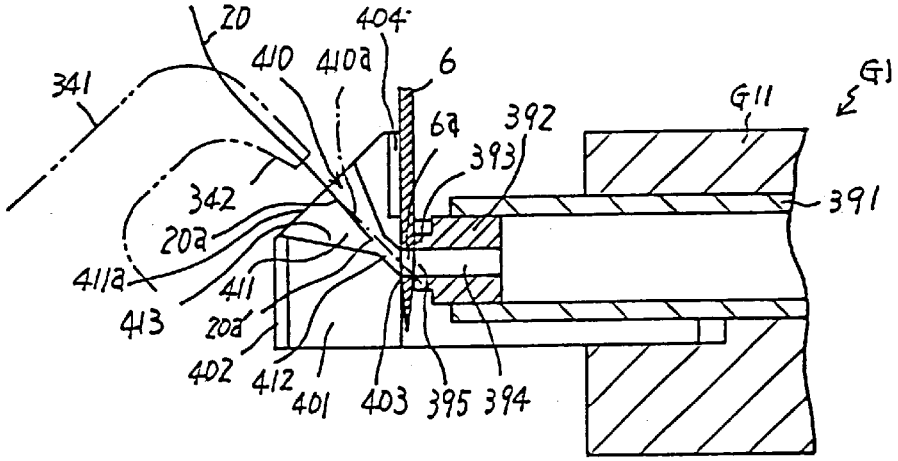
FIG. 31 is a longitudinal section view showing a state where the front end portion of the pulled down thread is brought into a guide hole of the thread passing mechanism.

The passing first process will be described. When the arm F1 reaches the lowered position as described above, as shown in FIG. 31, the front end portion 20*a* of the thread 20 nipped by the nipping pieces 341 enters substantially straightly the guide portion 411 along the axis 410*a* of the guide hole 410 because the guide hole is formed in the above-mentioned direction. As shown in FIG. 32, the front end portion reaches the thread eye 6*a* of the needle 6 via the delivery portion 412, and is then passed through the thread eye to enter the interior of the suction hole 394 of the suction nozzle 392 via the thread eye. In this process, even when the front end portion 20*a* of the thread 20 is previously bent, the front end portion 20*a* is mechanically guided by the guide face 413 to reach the delivery portion 412.

Figure 33:
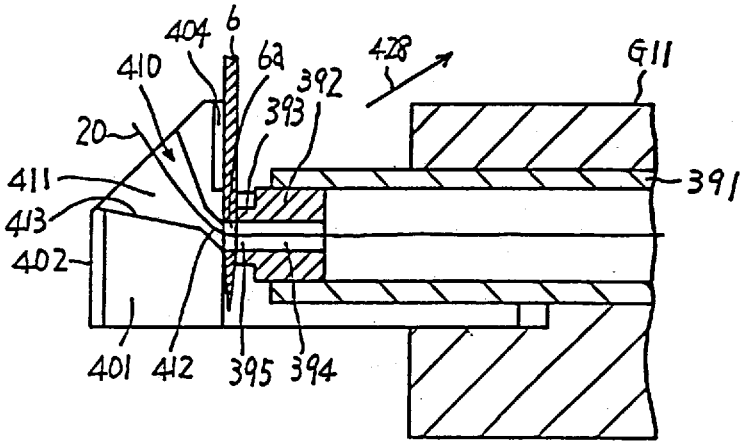
FIG. 33 is a longitudinal section view showing a state where a thread of a sufficient length is reeved through the thread eye.

The passing second process will be described. When the front end portion 20*a* of the thread 20 reaches the suction hole 394 as described above, the driving device F312 is operated so that the pair of nipping pieces 341 are separated from each other and the nipped thread 20 is then released. As shown in FIG. 33, thereafter, the thread 20 is deeply pulled into the interior of the suction pipe 391 through the thread eye 6*a* by the above-mentioned air flow. As a result, the thread 20 elongating from the selection device A to the thread passing device G has a state where it is tightly stretched. When the thread is deeply pulled in as described above, it is possible to prevent an accident in which the thread 20 passed through the thread eye 6*a* erroneously slips off from the thread eye 6*a* in the releasing process which will be described later, from occurring.

In the passing second process, the front end portion 20*a* of the thread is obliquely downwardly passed with respect to the thread eye 6*a* of the needle 6 by the pulling-down device F. On the other hand, the thread passing mechanism G1 is horizontally disposed in order to prevent the mechanism from interfering with the bed of the sewing machine. Under such conditions, there is a possibility that the front end portion 20*a*' of the thread 20 which has been passed through the thread eye 6*a* abuts against the side wall of the suction hole 394 of the passing means G12. However, the thread 20 which has been passed through the thread eye 6*a* is guided by the air flow which passes through the thread eye 6*a* and the suction hole 394 and is directed to a further inner portion. As a result, the operation of passing the long length of the thread 20 can be surely conducted.

Figure 21B:
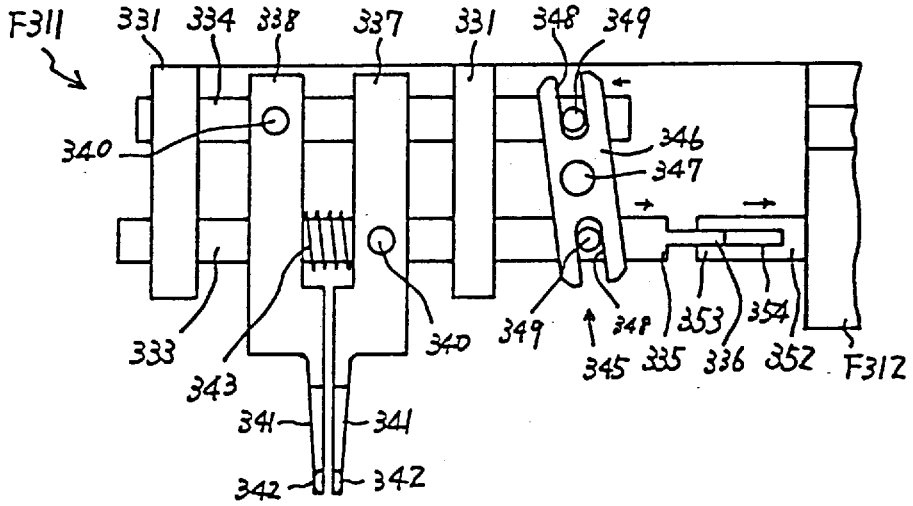
Figure 21C:
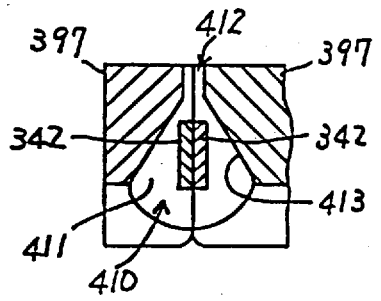
FIGS. 21C and 21D are section views respectively showing the relationships between guiding means and a nipping portion in the states of FIGS. 21A and 21B, in a cut state along an axial position of a guide hole.
Figure 21D:
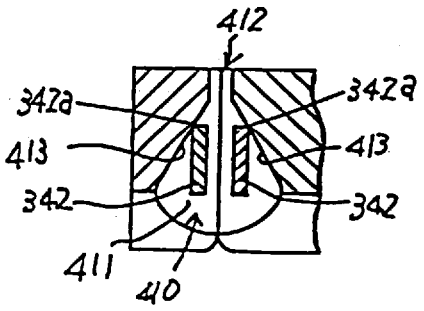

In the case where the thread 20 is released from the nipping pieces 341 by the operation of the driving device F312, it is possible to prevent the nipping pieces 341 from being damaged and the guide face 413 from being scratched because of the following reason. At the timing when the passing first process is terminated, as shown in FIG. 32, the nipping portions 342 of the nipping pieces 341 enter the inner place of the small diameter in the guide portion 411 of the guide hole 410. When the driving device F312 is operated under this state and the pair of nipping pieces 341 are opened, the front end portions 342*a* of the nipping portions 342 abut against the guide face 413 as shown in FIG. 21D. However, the operation of the driving device F312 is conducted in the form of retraction of the driving rod 352, and the pair of nipping pieces 341 are opened by the spring 343. When the front end portions 342*a* of the nipping portions 342 abut against the guide face 413 as described above, therefore, the driving portion 353 is separated from the driven portion 335 and the separation of nipping pieces 341 is stopped as shown in FIG. 21B. Consequently, the nipping pieces 341 are prevented from being damaged and the guide face 413 from being scratched. The opening of the pair of the nipping pieces 341 which has been stopped by the above-mentioned abutment is conducted by the urging force of the spring 343 when the nipping pieces 341 are separated from the inlet 410 in the succeeding releasing process. When the front end portions 342*a* of the nipping portions 342 abut against the guide face 413, the overlapping state of the pair of the clamping faces 401 which oppose each other is maintained by the spring 405.

Figure 34:
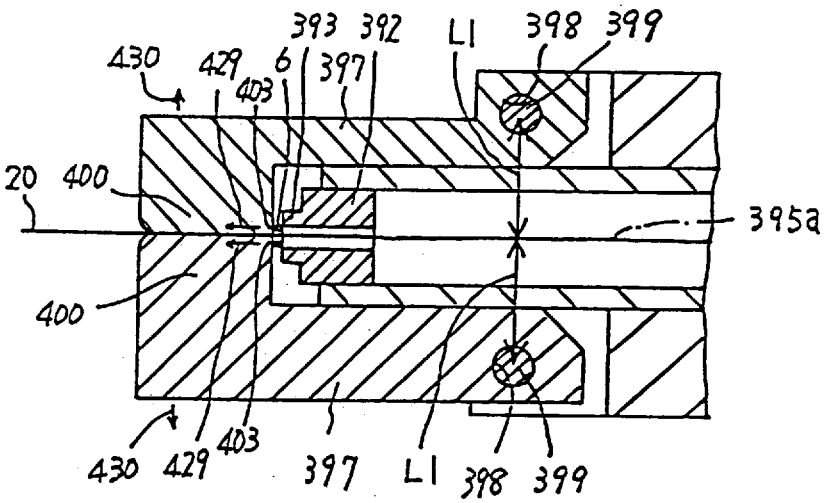
FIG. 34 is a horizontal section view illustrating the manner of applying a force in the case where the thread passing mechanism is separated from the needle.
Figure 35A:
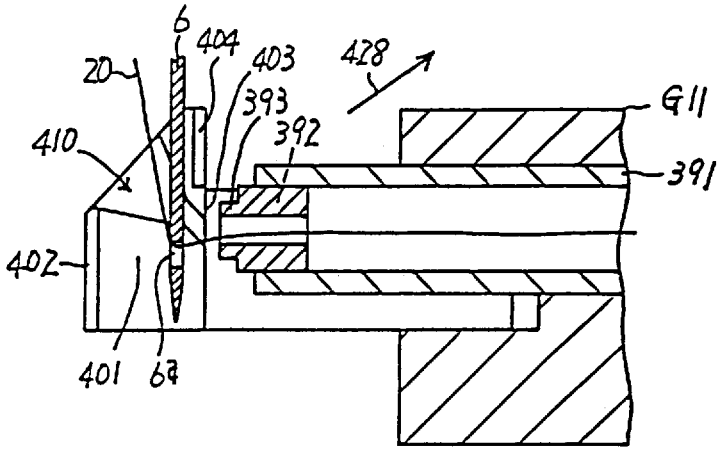
FIG. 35A is a longitudinal section view illustrating a process of separating the thread passing mechanism from the needle, and showing a state where the needle is moved to the gap between the clamping faces.
Figure 35B:
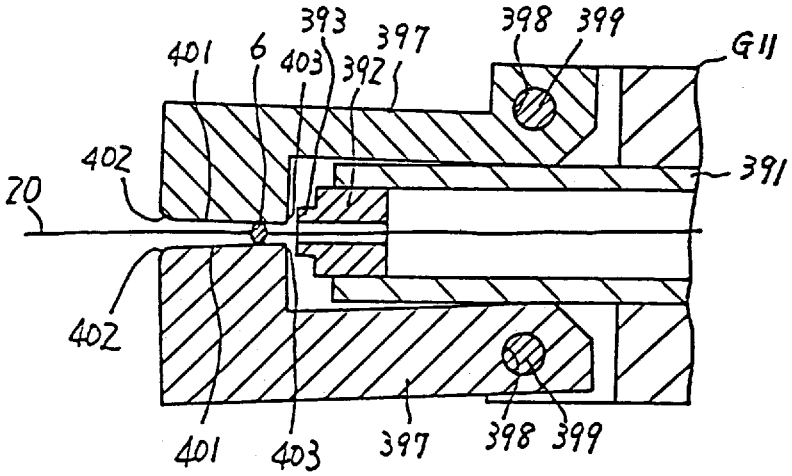
FIG. 35B is a horizontal section view in the state of FIG. 35A.

The releasing process will be described. This process is conducted by returning the arm F1 to the elevated position, and retracting the thread passing mechanism G1 from the thread passing position G1B of FIG. 2 to the retraction position G1A by the driving mechanism G3. Hereinafter, the process will be described. The elevation of the arm F1 is conducted by the driving mechanism F2. In this case, the nipping pieces 341 are separated from the inlet 410 and then returned to the initial state shown in FIG. 18. On the other hand, the thread passing mechanism G1 is moved by the driving mechanism G3 in the direction of an arrow 428 which is opposite to that of the arrow 425. At the start of this movement, as shown in FIG. 34, a force in the direction of arrows 429 is applied from the needle 6 to the holding portions 403 of the pair of clamping arms 397. In each of the clamping arms 397, the position which is laterally separated by a distance L1 from the line of action of the force (which coincides with the position of the axis 395*a*) which is applied to the holding portion 403 in the direction of the arrow 429 is pivotally attached. Therefore, the force in the direction of the arrow 429 causes a force in the opening direction indicated by arrows 430 to be applied. The clamping arms 397 are pushingly opened by the force 430. In accordance with the movement of the thread passing mechanism G1 in the direction of the arrow 428, the needle 6 is relatively moved into the gap between the clamping faces 401 as shown in FIG. 35. Also during this movement, the suction of the thread into the suction pipe 391 due to air is continued.

Figure 36A:
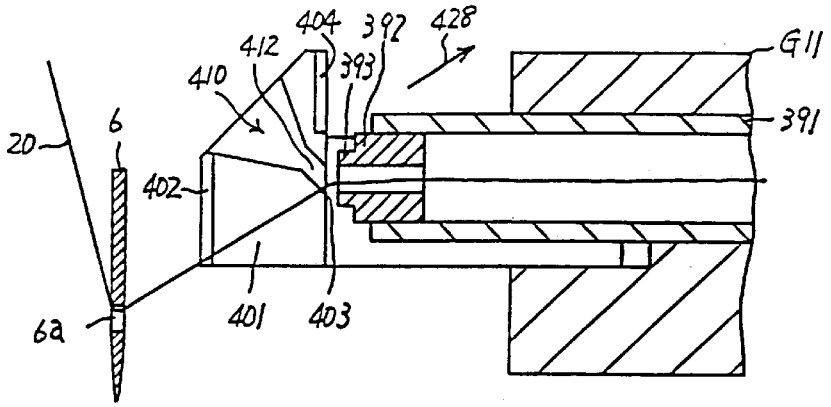
FIG. 36A is a longitudinal section view illustrating the step of separating the thread passing mechanism from the needle, and showing a state where the needle has escaped from the gap between the clamping faces.
Figure 36B:
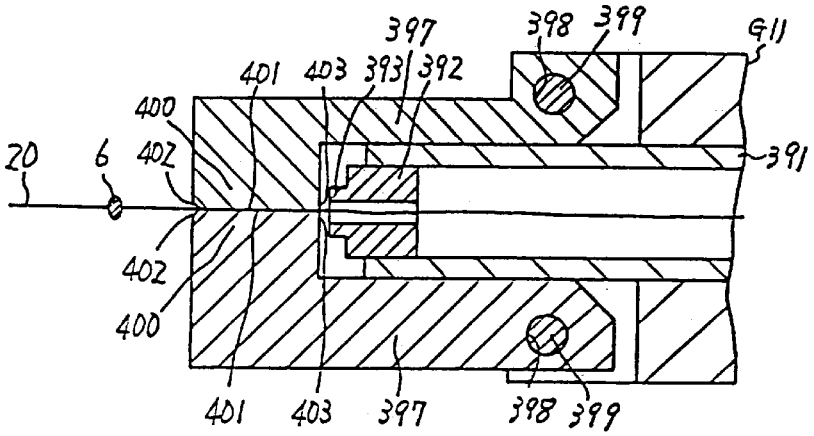
FIG. 36B is a horizontal section view in the state of FIG. 36A.
Figure 37:
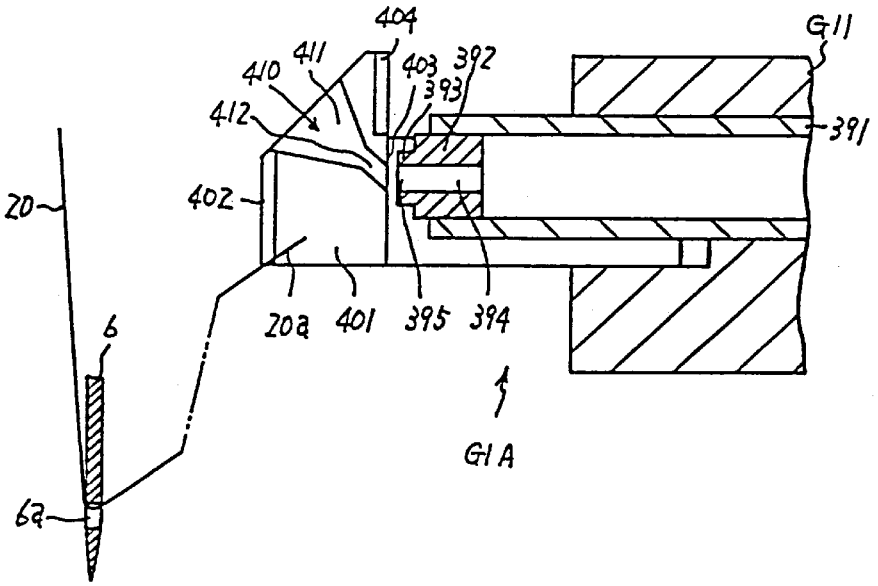
FIG. 37 is a longitudinal section view showing a state where the thread passing mechanism separated from the needle is moved to a retraction position.

Immediately after the needle 6 is relatively passed through the gap between the clamping faces 401 as shown in FIG. 36, as a result of the continuation of the movement of the thread passing mechanism G1 in the direction of the arrow 428, the clamping faces 401 are again closed so as to clamp the thread 20 in the region from the thread eye 6*a* to the suction port 395. Therefore, it is possible to prevent the thread 20 from erroneously slipping off from the thread eye 6*a*. Also after this clamping operation, the movement of the thread passing mechanism G1 in the direction of the arrow 428 is continued. In this case, the force which is exerted by the clamping faces 401 to clamp the thread 20 is set to be a relatively low level (i.e., the spring 405 is weak), and hence the thread 20 slides between the clamping faces 401 while maintaining the stretched state in accordance with the movement of the thread passing mechanism G1 (the thread is not further pulled out from the side of the thread selection device A). Also in the state where the thread passing mechanism G1 reaches the retraction position G1A as shown in FIG. 37, the front end portion 20*a* of the thread 20 is kept to be in the state where it is clamped by the clamping faces 401. The length of the thread which is to be fed out from the thread supply in the first and second steps and the passing first and second process of the third step is set so that the above-mentioned is attained.

After the pulling down of the thread 20 and the insertion into the thread eye 6*a* are completed as described above, the mechanisms of the sewing machine such as the needle 6, the presser foot 7, and the shuttle start to operate, thereby starting the stitching. In the start of the stitching, the front end portion 20*a* of the thread 20 is clamped and held by the clamping faces 401, and hence there are the following features. The thread 20 is prevented from erroneously slipping off from the thread eye 6*a*. Furthermore, the start of tangling of the above-mentioned thread (needle thread) 20 and the thread (bobbin thread) fed out from the shuttle is ensured, and hence the stitching can be smoothly started. Moreover, it is possible to prevent an accident in which the portion of the thread 20 ranging from the portion passed through the thread eye 6*a* to the front end portion 20*a* is erroneously stitched to the cloth by the needle 6, from occurring. After the stitching is started, the front end portion 20*a* of the held thread 20 slips off from the clamping faces 401 as the stitching advances, and the normal stitching state is attained.

When the stitching is conducted with using the thread passed to the needle, the thread 20 fed out from the bobbin 20 reaches the selection device while sliding over the peripheral face of the drum 64 when passing through the retraction device 11, and then the needle. In this case, a tension is applied to the thread 20 directed to the thread selection device A, by the friction resistance generated there by the sliding movement over the peripheral face of the drum 64, whereby the portion of the thread between the retraction device 11 and the thread selection device A is prevented from slacking.

Figure 14:
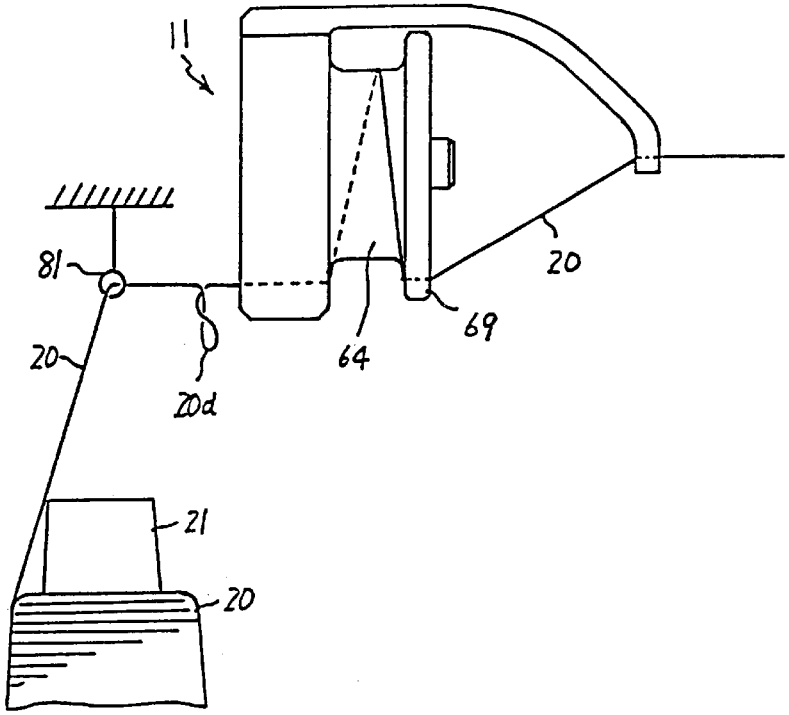
FIG. 14 is a side view showing a state where a thread pulled out from a bobbin is twisted.
Figure 15A:
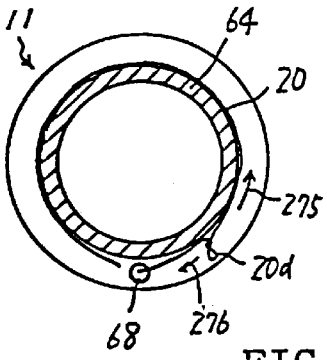
FIGS. 15A to 15C are section views showing a state in which the twist of the thread of FIG. 14 is canceled.
Figure 15B:
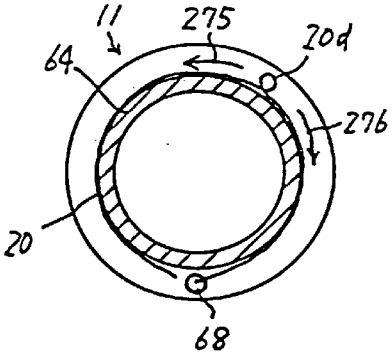
Figure 15C:
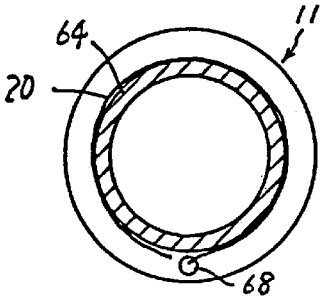
Figure 16:
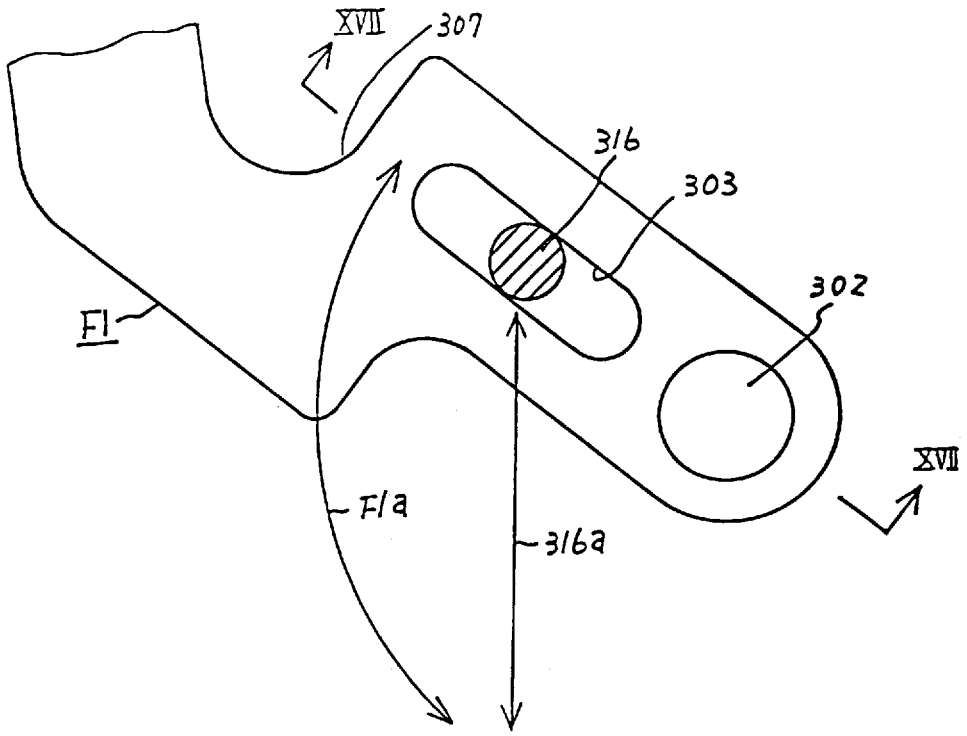
FIG. 16 is an enlarged view of a basal portion of an arm.
Figure 17:
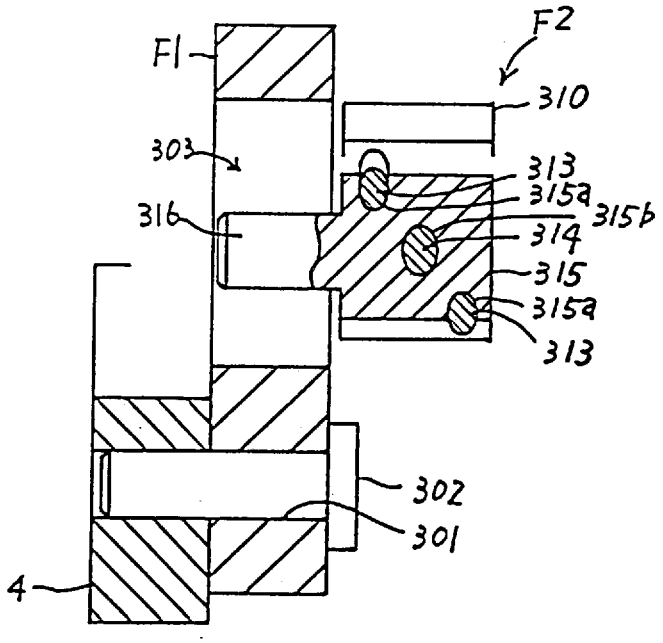
FIG. 17 is a section view showing the relationship between the arm basal portion and a driving mechanism, taken on the line XVII—XVII of FIG. 16.
Figure 18:
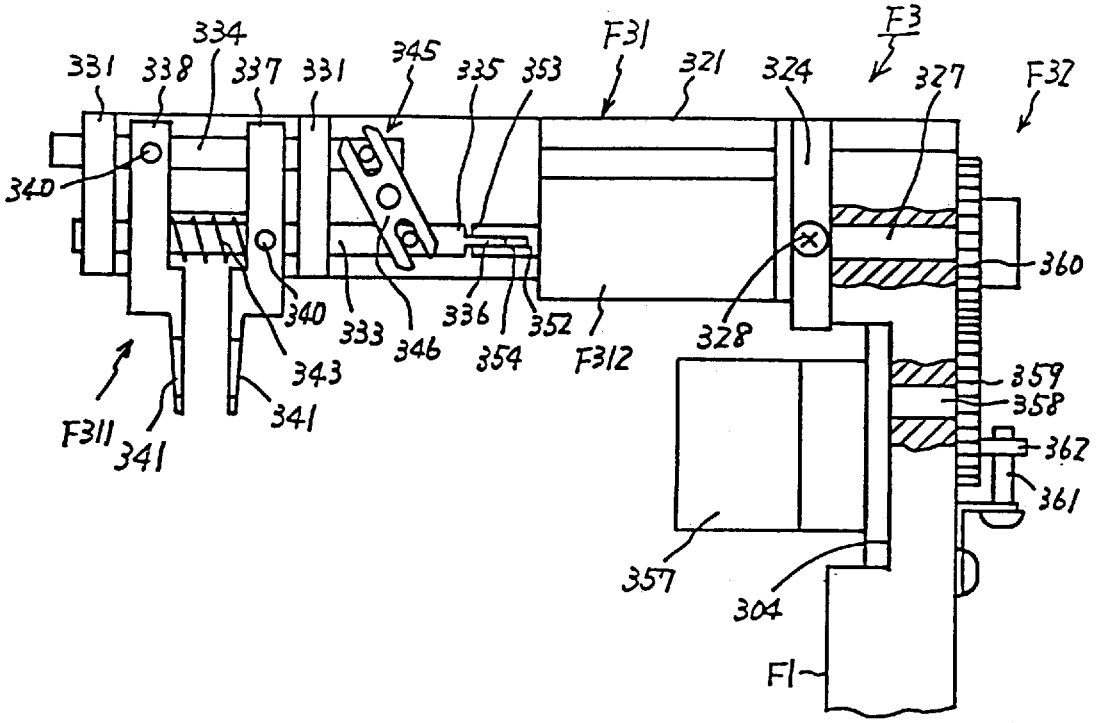
FIG. 18 is a view of a catch device as seen in the direction of the arrow XVIII of FIG. 2.
Figure 19:
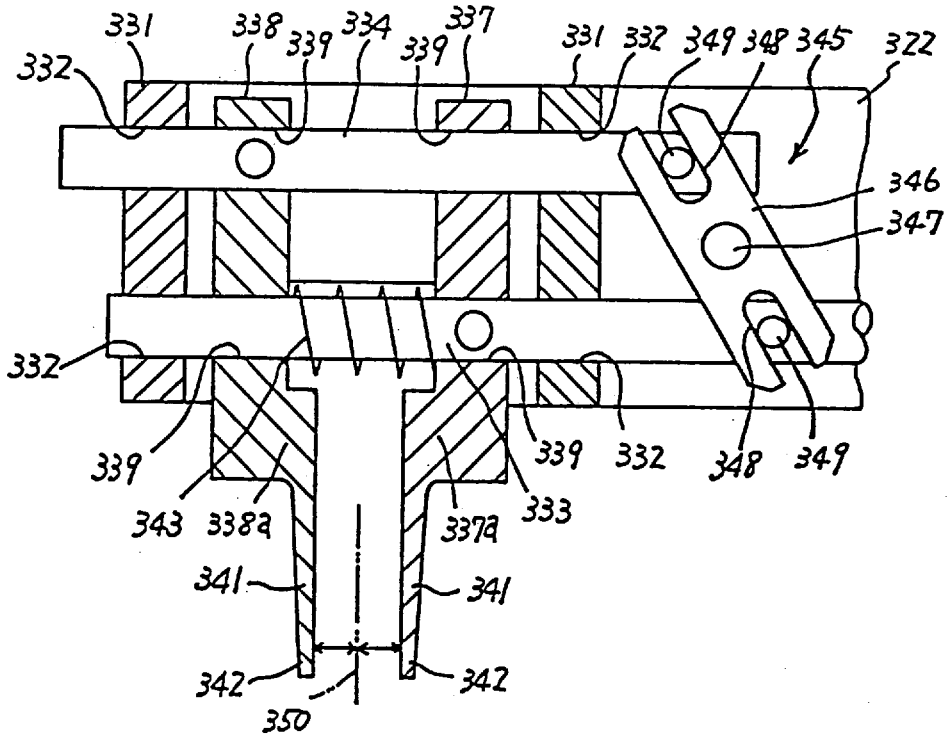
FIG. 19 is a section view showing a nipping mechanism.

When a loop-like twist 20*d* is produced in the thread 20 as shown in FIG. 14 by pulling out the thread 20 from the bobbin 21 in the axial direction, the sliding movement of the thread 20 over the peripheral face of the drum 64 eliminates the twist. Hereinafter, this will be described. As shown in FIG. 15A, the twist 20*d* reaches the peripheral face of the drum 64 via the through hole 68 of the retraction device 11. The pulling force due to the stitching needle is applied as indicated by an arrow 275 to the thread 20 sliding over the peripheral face of the drum 64, and also the force due to the friction resistance on the peripheral face of the drum is applied as indicated by an arrow 276 to the thread. When the thread 20 is gradually pulled as the stitching advances under the state where the force 276 is applied, the twist 20*d* is moved as shown in FIG. 15B while being gradually canceled by the above-mentioned force 276. When the portion of the thread between the through hole 68 and the twist 20*d* is gradually prolonged as the twist 20*d* is moved, the friction resistance due to the sliding movement of the thread and the peripheral face of the drum is increased, and the force of the arrow 276 is increased. Then, the cancellation of the twist 20*d* is further advanced, and finally the twist is completely canceled as shown in FIG. 15C. The twist 20*d* is canceled in this way. As a result, the cutting of the thread due to the existence of a twist is prevented from occurring, thereby enabling the stitching to be smoothly continued.

The winding of the thread 20 on the peripheral face of the drum 64 prevents the thread 20 around the bobbin 21 from, when the thread is cut off in a stage following the retraction device 11 (on the side of the thread selection device A), being frayed from the bobbin 21 to drop down. Specifically, the thread 20 is pulled out from the bobbin 21 in the direction of the axis of the bobbin. In the case of a thread which is hardly twisted, therefore, the thread 20 between the bobbin 21 and the retraction device 11 has a force by which the thread is disposed to be twisted because of the twist of the thread itself. The force appears as a force which causes the thread between the bobbin 21 and the retraction device 11 to shrink. In this case, when the thread 20 is not wound on the drum 64, the thread drops as described below. When the thread is cut in the above-mentioned side, the thread is passed through the retraction device 11 and returned toward the bobbin 21 by the shrinking force, and the thread around the bobbin 21 is frayed from the bobbin 21 and drops. Such a drop produces a problem as follows. During the process in which the front end of the dropped thread 20 is pulled up in order to again pass the thread 20 through the retraction device 11, etc., the middle portion of the dropped thread is caught by the lower side of the bobbin 21. The difficult work of disentangling the thread must be conducted. When the thread 20 is wound on the peripheral face of the drum 64 in the manner as described above, however, the friction resistance is produced there as described above. Even when the thread is cut off in the above-mentioned side, therefore, the thread is prevented from passing through the retraction device 11 to return to the side of the bobbin 21. As a result, the above-mentioned fray is prevented from occurring and the difficult work can be avoided.

Figure 38:
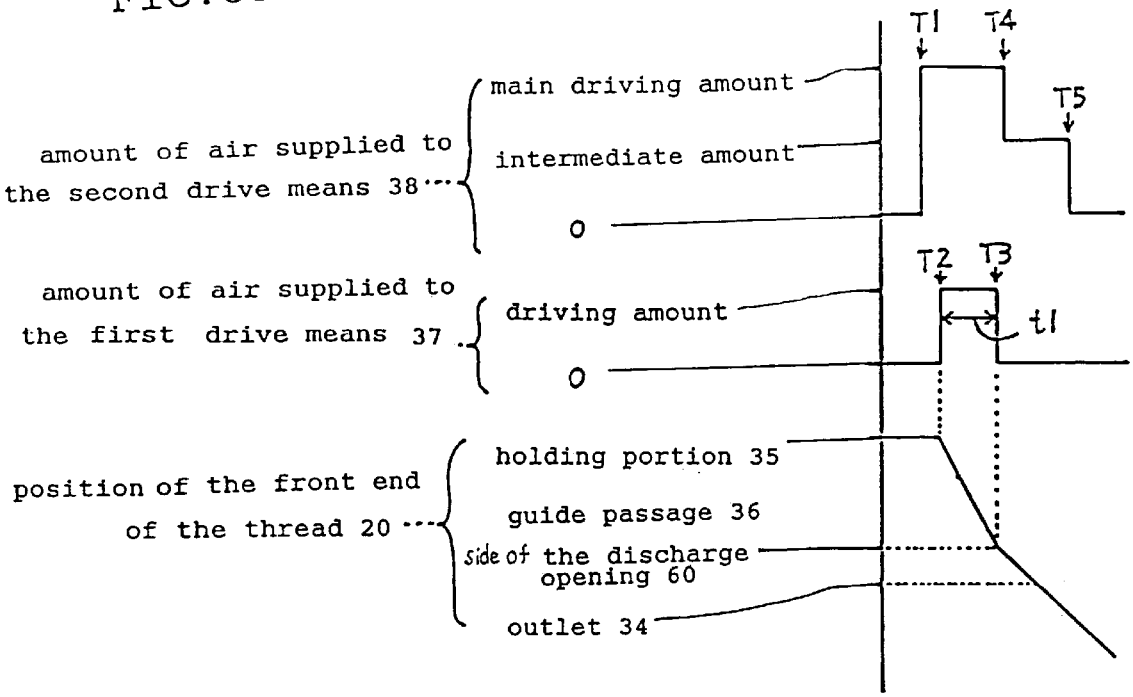
FIG. 38 is a time chart showing another example of the operation of the selection mechanism.

Another example of the operation of feeding one thread selected from the threads in the holding portions 35 in the selection mechanism B to the outlet 34 and feeding out the thread therefrom will be described with reference to FIG. 38. In response to the instructions indicating the extraction of the selected thread, the main driving amount of air is first supplied to the second drive means 38 at timing T1. Immediately after this supply or at timing T2, a predetermined amount of air is supplied to the first drive means 37. The main driving amount of air is an amount adequate for, when this amount of air is ejected from the discharge opening 60 toward the outlet 34, guiding the air fed out from the first drive means 37 to the outlet 34 through the guide passage 36, and generating a negative pressure at a position in the vicinity of the discharge opening 60 in the lower portion of the guide passage 36, thereby further driving the thread reaching to the position, into the guide pipe 202. For example, the main driving amount is twice that of the air from the first drive means 37.

As a result of such supplies of air, the front end of the thread positioned in the holding portion 35 advances toward the guide passage 36. The air supply to the first drive means 37 is ended at timing T3. The above-mentioned air supply to the first drive means 37 causes the front end of the thread to reach an intermediate point of the guide passage 36 such as the side position in the vicinity of the discharge opening 60 of the second drive means 38. The period t1 between the timing T2 and the timing T3 is preset to be a time which is required for the thread in the holding portion 35 to reach a position in the vicinity of the discharge opening 60. For example, a time which is experimentally obtained may be set. When the air supply to the first drive means 37 is stopped at the timing T3, the amount of air supplied to the second drive means 38 is reduced immediately after the stop or at timing T4. For example, the air amount may be set to be an intermediate value. The air supply of an intermediate amount to the second drive means 38 causes the thread 20 which has reached the side position of the discharge opening 60, to smoothly reach the outlet 34 with riding on the gentle air flow from the guide passage 36 to the outlet 34 through the guide pipe 202, and then fed out therefrom. When the thread 20 is fed out from the outlet 34 as described above, the air supply of the intermediate amount is stopped at timing T5.

The amount of air supplied to the second drive means 38 is reduced because of the following reason. When the amount of air ejected from the discharge opening 60 of the second drive means 38 remains to be large even after the air flow from the first drive means 37 to the guide passage 36 is stopped, there arises a fear that, for example, a swirling flow of air is produced in the guide passage 36 and the thread 20 tangles around the first guide member 26. The intermediate amount may set to be a value at which such tangling can be prevented from occurring, for example, a half of the main driving amount. The switching from the main driving amount to the intermediate amount may be conducted at a timing when, even when the amount of air supplied to the second drive means 38 is switched from the main driving amount to the intermediate amount, the driving force can be applied to the thread 20 by the intermediate amount of air supplied to the second drive means 38 and the thread 20 can be moved toward the outlet 34. For example, the switching is conducted when the front end portion of the thread 20 reaches a position in the vicinity of the discharging opening 60. A specific example is the timing when the front end portion of the thread reaches the side position of the discharge opening 60 as described above. For example, such a control may be conducted by controlling the period between timing T2 when the operation of the first drive means 37 is started, and timing T4 when the switching is performed. For example, the period may be experimentally obtained. The amount of air supplied to the second drive means 38 may be controlled by using, for example, a proportional control valve as a valve 133A which conducts the control. The change of the amount of air supplied to the second drive means 38 may be conducted not only in two steps as described above but also in steps of a larger number.

The period between timing T1 and timing T5 is preset to be a period for attaining the state where the thread is fed out from the outlet 34. For example, the period may be experimentally obtained. An example of the period is 0.2 sec.

The operation in which the thread 20 is fed out from the outlet 34 under a state where the amount of air supplied to the second drive means 38 is reduced to the intermediate value is effective also in the following aspect. When the air flow which is ejected from the discharge opening 60 and further ejected from the outlet 34 through the guide pipe 202 spreads as moving downwardly and abuts against a shielding member 267, the air laterally flows. In the case where the amount of air supplied to the second drive means 38 is small as described above and the air flow is gentle, even when the air abuts against the shielding member 267, the lateral air flow can be suppressed to a low degree. When the lateral air flow is small, the possibility that the thread 20 is laterally fluctuated by the lateral flow can be suppressed to be small. As a result, the operation of bringing the thread 20 to the front of the suction port 226 through the inside of the shielding member 267 can be ensured.

The supply of air to the second drive means 38 at the intermediate value may be conducted also in the case where tangling of the thread on the first guide member 26 seems to occur in the selection mechanism B, such as that where the thread is not fed out from the outlet 34 even though air is supplied to the first and second drive means 37 and 38 of the selection mechanism B. In this case, when the air supply at the intermediate value is conducted as described above, a smooth air flow directed from the guide passage 36 to the outlet 34 is formed and the thread can be fed out from the outlet 34 by the air flow. In order to easily check by direct optical observation whether the thread tangles on the first guide member 26 or not, the second guide member 27 may be made of a transparent material.

Figure 39:
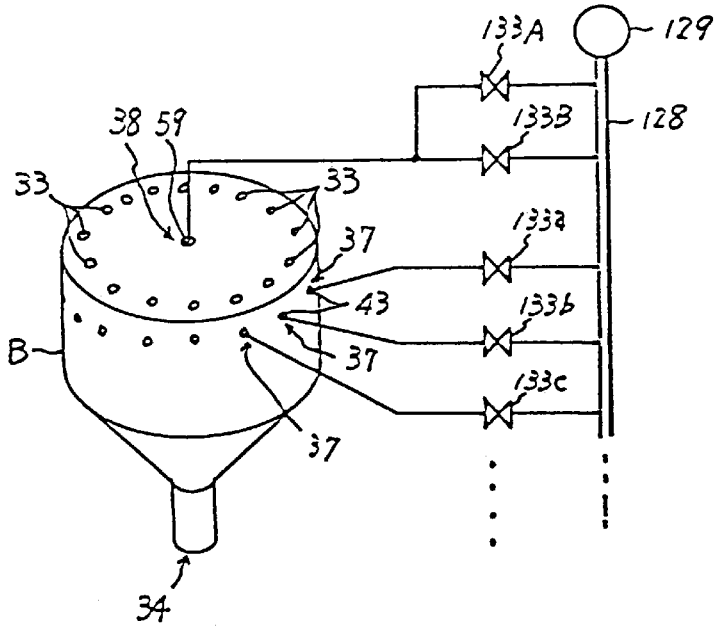
FIG. 39 is a diagram showing another example of means for changing an amount of air supplied to second drive means.

FIG. 39 shows another example of the means for controlling the amount of air supplied to the second drive means 38. When the amount of air which can pass through the valve 133 is small (in-the embodiment, when the effective section area of the valve is 1.3 $mm^2$ and the air pressure is 6 $Kgf/cm^2G$, for example, the flow amount is 1.63 Nl/sec.), two valves 133A and 133B for the air supply to the second drive means 38 may be disposed in parallel as illustrated. The air supply at the main driving amount may be conducted by opening both the valves, and the air supply at the intermediate value may be conducted by opening only one of the valves. In order to control the air supply to the second drive means 38 in steps of a larger number, the valves of a larger number may be disposed in parallel.

The passing first process may be conducted in the following manner. An air flow from the guide hole 410 to the suction hole 394 through the thread eye 6*a* is formed by the air suction by the passing means G12. The air flow in the guide portion 411 of the guide hole 410 is a flow directed from an entrance portion 411*a* of a larger diameter to the delivery portion 412 of a smaller diameter. In the guide portion 411, with respect to the flow directed to the delivery portion 412, the strength in the vicinity of the guide face 413 is higher than that in the vicinity of the axis 410*a*. In the guide hole 410 of such a state, when the front end portion 20*a* of the thread 20 nipped by the nipping pieces 341 is brought to the vicinity of the delivery portion 412, the thread is disposed to maintain the state where it elongates along the axis 410*a* by means of the mechanical stiffness of the thread itself, and moreover a force for making the thread elongate along the axis 410*a* is applied also by the above-mentioned air flow. As the nipping pieces 341 advance, the front end portion 20*a* passes through the delivery portion 412 and the thread eye 6*a* to reach the suction hole 394. Therefore, the first process is surely executed.

In the guide hole 410, the above-mentioned air flow is formed. Even in the state where the thread 20 nipped by the nipping pieces 341 is not stiff or where a long length of the thread is projected from the nipping pieces 341 so that the front end portion 20*a* hangs, when the front end portion 20*a*' of the thread enters the guide hole 410, therefore, the front end portion 20*a*' is first guided to the delivery portion 412 by the air flow moving along the guide face 413, then to the thread eye 6*a* by the air flow moving through the delivery portion 412, and is passed through the eye to reach the suction hole 394.

Since such an air flow is formed, the nipping pieces 341 may cancel the holding of the thread 20 when the front end portion 20*a*' of the thread 20 reaches a position in the inner portion of the guide portion 411 and in the vicinity of the delivery portion 412. Also in such a case, the thread 20 is caused to pass through the delivery portion 412 and the thread eye 6*a* to reach the suction hole 394 by the air flow.

Figure 40A:
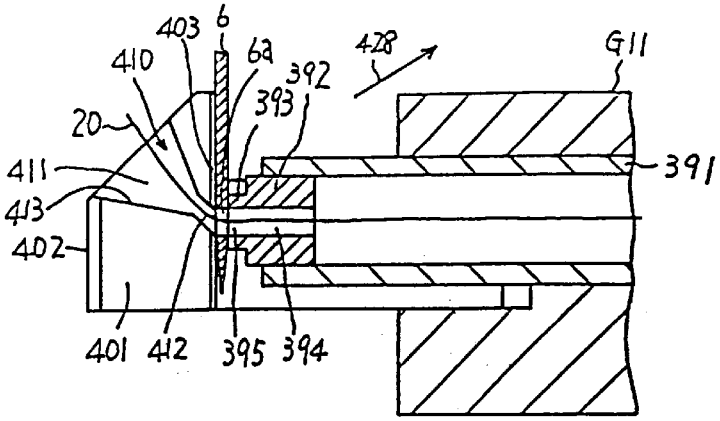
FIG. 40B is an enlarged horizontal section view.
Figure 40B:
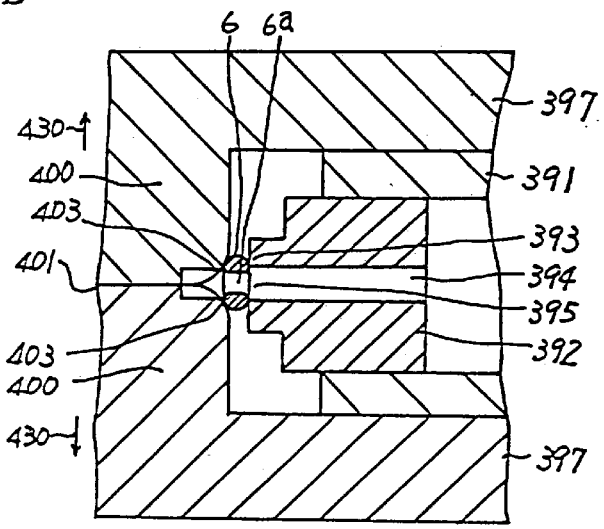

FIGS. 40A and 40B show the thread passing mechanism having the holding portion of another shape, i.e., an example in which the holding portion 403 is formed into an arcuate face as an example of a slant face with respect to the traveling direction of the thread passing mechanism G1. This configuration further smoothens the process of releasing the thread passing mechanism G1 from the needle 6. Specifically, when the thread passing mechanism G1 is moved from the illustrated state in the direction of the arrow 428 with respect to the needle 6, the force in the direction of the arrow 430 is applied to the clamping arms 397 by the existence of the distance L1 as described above. In addition to the force, an opening force in the direction of the arrow 430 is applied to the pair of clamping arms 397 by the guidance due to the holding portion 403 of the slant face. As a result, the pair of clamping arms 397 are easily opened, so that the needle 6 can enter the gap between the clamping faces 400. Therefore, release of the thread passing mechanism G1 from the needle 6 can be easily conducted without erroneously breaking the needle 6.

Figure 41:
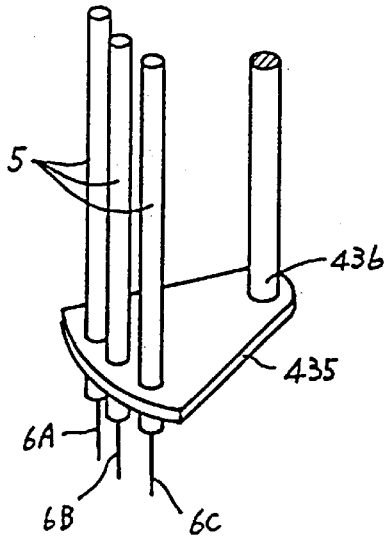
FIG. 41 is a perspective view showing an example in which a plurality of threads which can be selectively used are provided.

Next, another embodiment of the invention will be described with reference to FIG. 41. The embodiment shows an example in which the needle 6 corresponding to the size of the thread to be used in the stitching can be selected from plural needles 6. The reference numeral 435 designates a needle bar holding frame which is pivotally attached to the head frame so as to be horizontally rotatable about a shaft 436, and in which plural (for example, three) needle bars 5 are disposed so as to be vertically movable. A needle 6A for a thick thread, and a needle 6B for a thin thread are attached to the needle bars 5. In the embodiment, in place of a needle, a borer knife 6C for perforating the cloth is attached. In this configuration, the holding frame 435 is laterally moved by a driving mechanism which is not shown so that the needle bars 5 are exchangeably brought beneath the elevating body 418, and the stitching using the needles or the perforating work using the knife is conducted.

Figure 42:
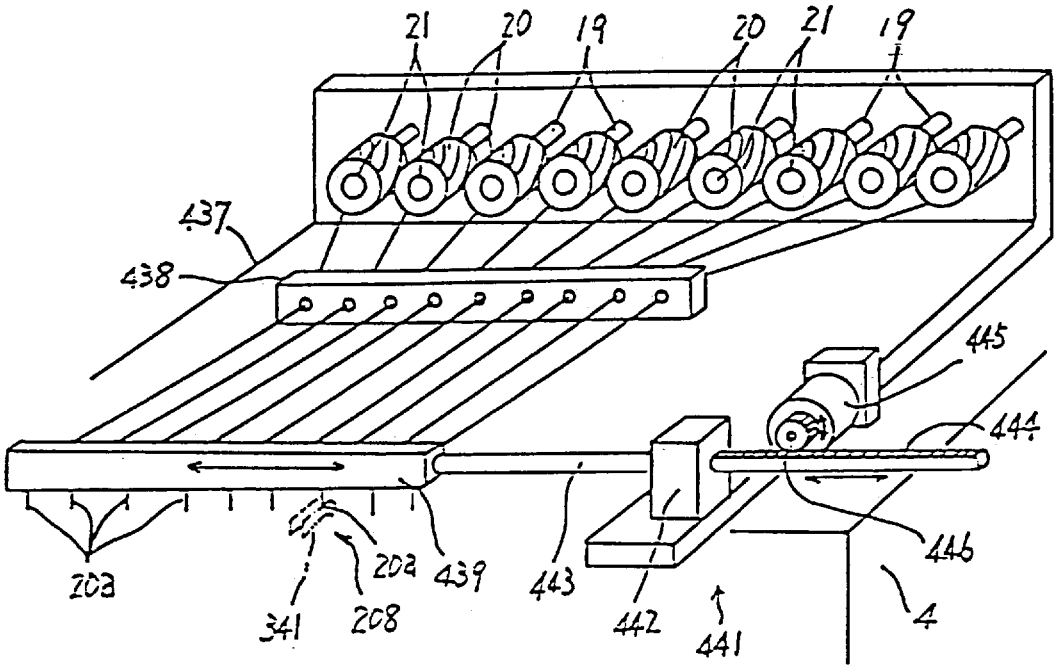
FIG. 42 is a perspective view showing another embodiment of a thread supply and the thread selection device.
Figure 43:
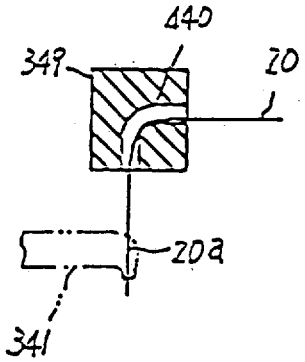
FIG. 43 is a longitudinal section view of a movable thread guide in FIG. 42.

FIGS. 42 and 43 show another embodiment of the thread supply and the thread selection device. In the figures, 437 designates a base which is attached to, for example, the head frame 4, 438 designates a thread guide attached to the base 437, 439 designates a movable thread guide which is laterally movable with respect to the base 437, and 440 designates guide holes which are formed in the thread guide 439 and guide threads in, for example, a downward direction. The reference numeral 411 designates a driving mechanism for driving the thread guide 439, 442 designates a guide body, and 443 designates a reciprocating rod supported by the guide body 442, one end of the rod being connected to the thread guide 439. The reference numeral 444 designates rack teeth, and 445 designates a driving motor. For example, a pulse motor is used as the driving motor. The reference numeral 446 designates a pinion which is attached to the rotation shaft of the motor and meshes with the rack teeth 444.

In this configuration, threads 20 are respectively delivered from a number of bobbins 21 mounted on bobbin holders 19, the threads 20 are passed through the thread guides 438 and 439, and their front end portions 20*a* hang from the guide holes 440. Under this state, the motor 445 is rotated in response to thread selection instructions, and the reciprocating rod 443 is laterally moved by the mesh between the pinion 446 and the rack teeth 444 to a predetermined position corresponding to the instructions. As a result, among the front end portions 20*a* of the plural threads 20, the one corresponding to the instructions is positioned in the extraction place 208. The front end portion 20*a* of the positioned thread 20 is caught by the nipping pieces 341 of the catch device.

Figure 44:
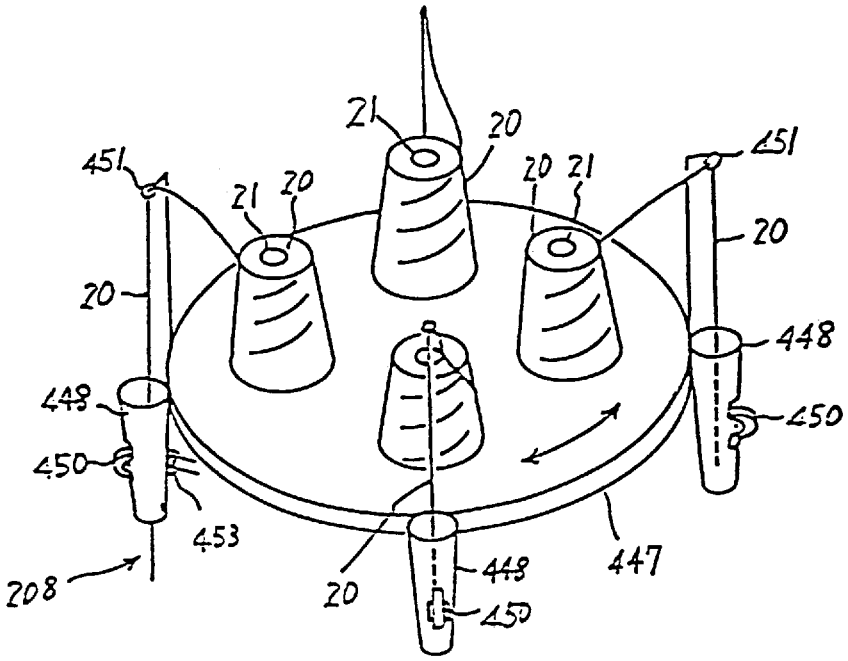
FIG. 44 is a perspective view showing a further embodiment of the thread supply and the thread selection device.
Figure 45:
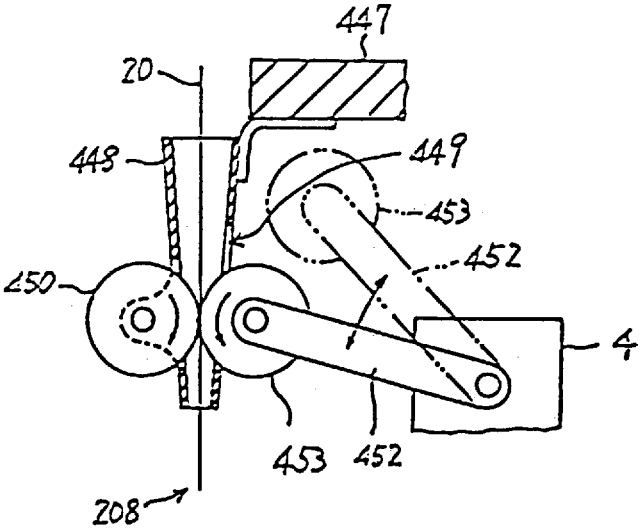
FIG. 45 is a longitudinal section view showing the relationship between the thread guide positioned above an extraction place and a mechanism for feeding out the thread.
Figure 46:
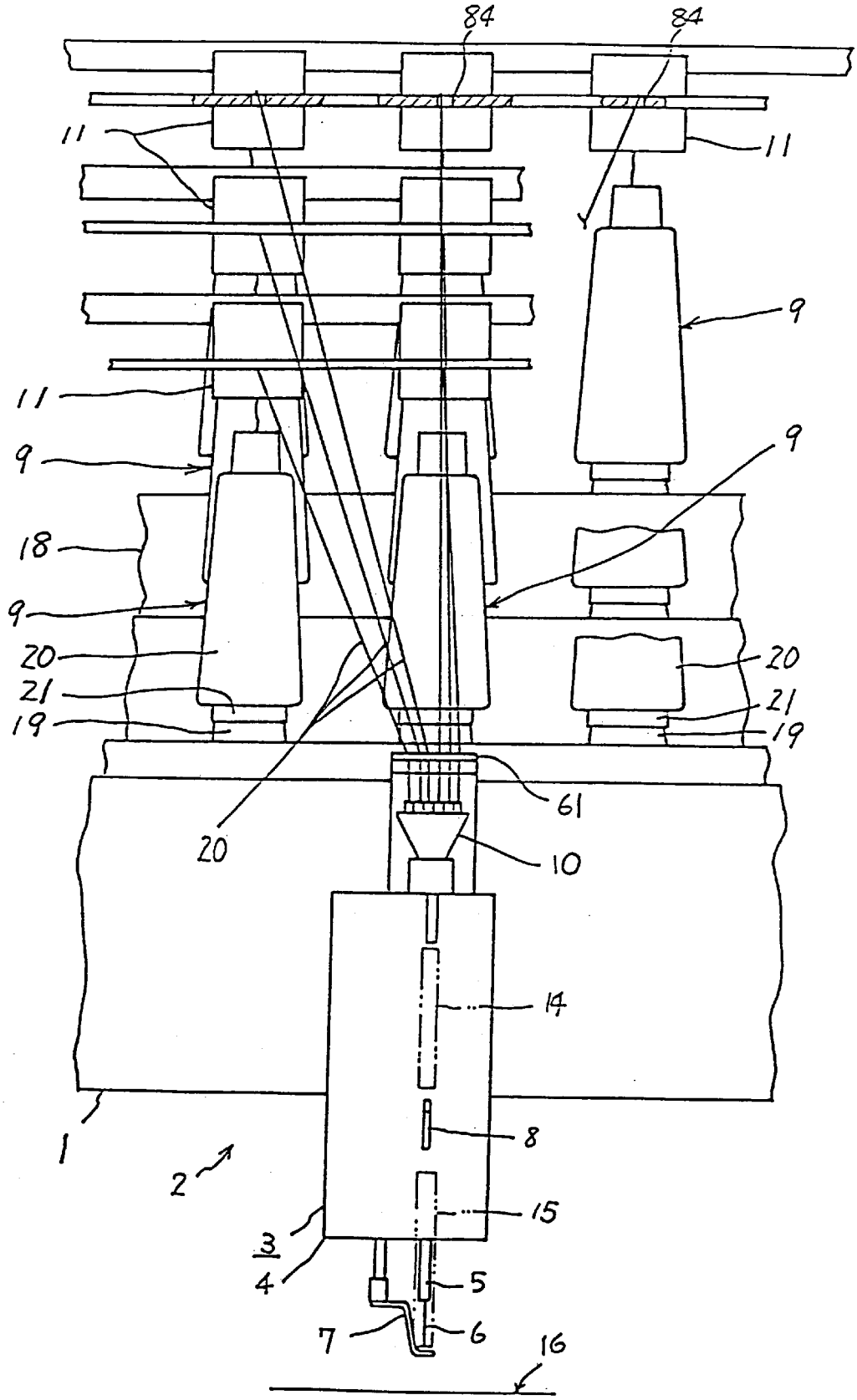
FIG.46 (PRIOR ART)
FIG. 46 is a front view of a multicolor sewing machine.
Figure 47:
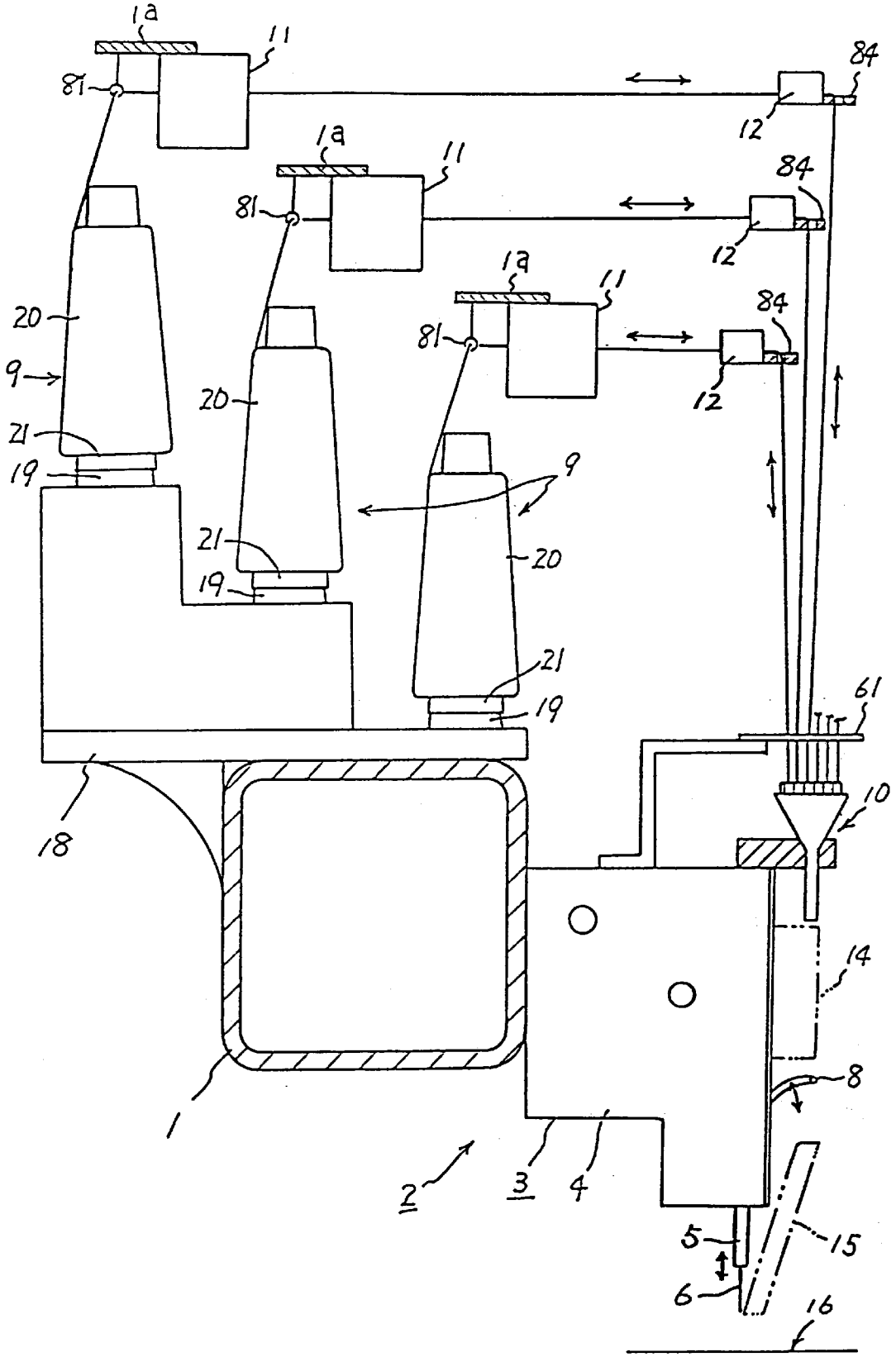
FIG. 47 (PRIOR ART)
FIG. 47 is a side view of the machine.
Figure 48:
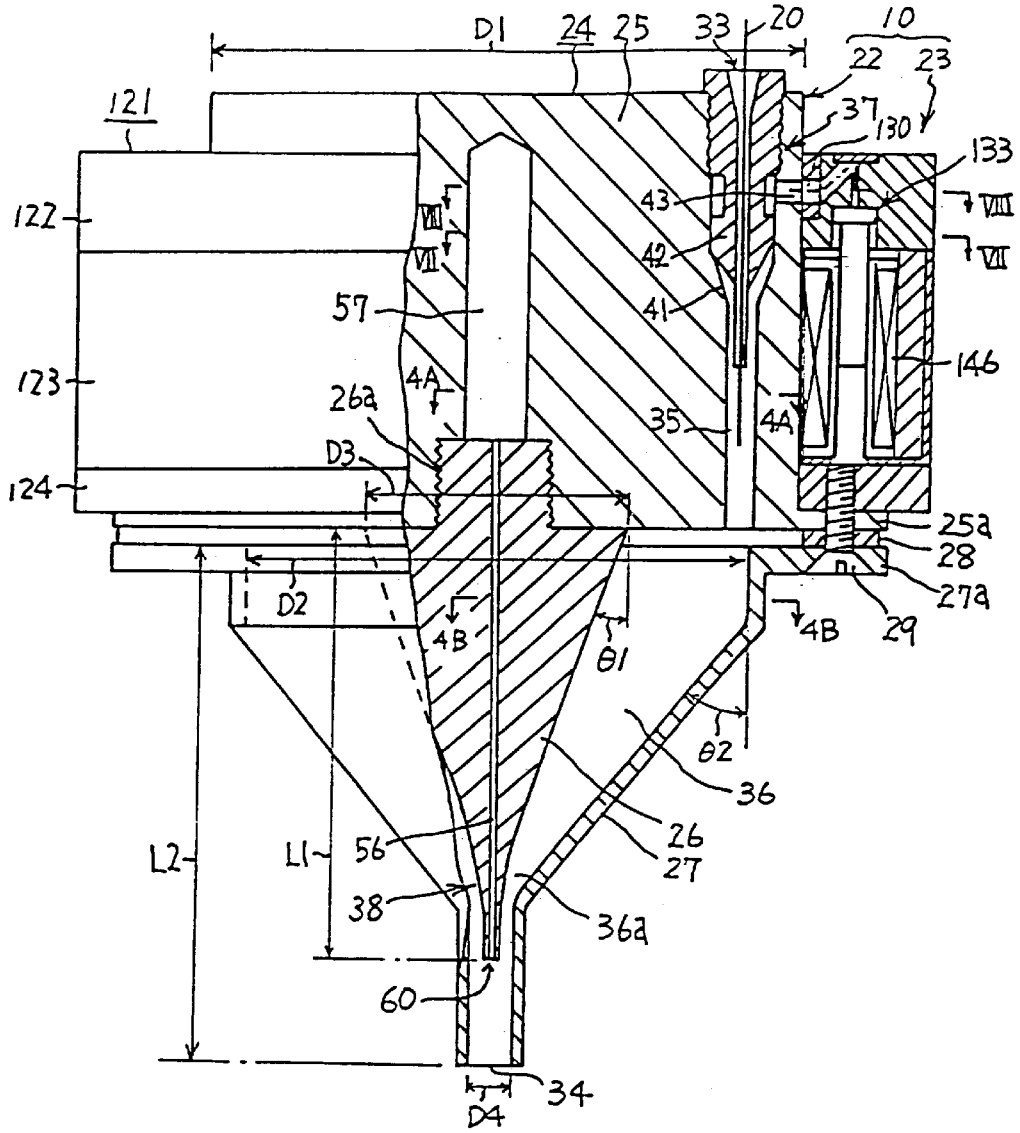
FIG.48 (PRIOR ART)
FIG. 48 is an enlarged view of a selection device, with partially cut away.
Figure 49A:
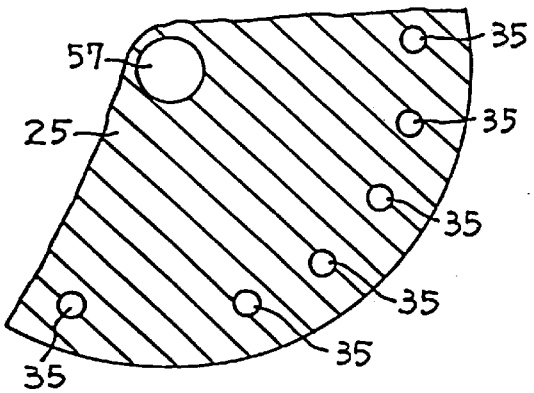
FIG.49A (PRIOR ART)
FIG. 49A is a section view taken on the line 4A—4A of FIG. 48.
Figure 49B:
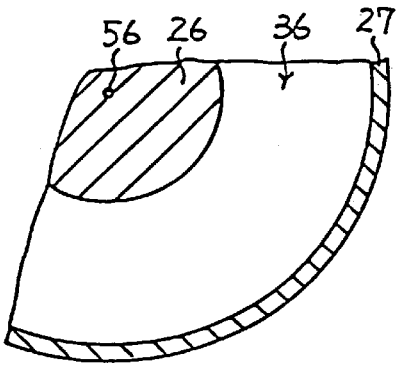
FIG.49B (PRIOR ART)
FIG. 49B is a section view taken on the line 4B—4B.
Figure 50:
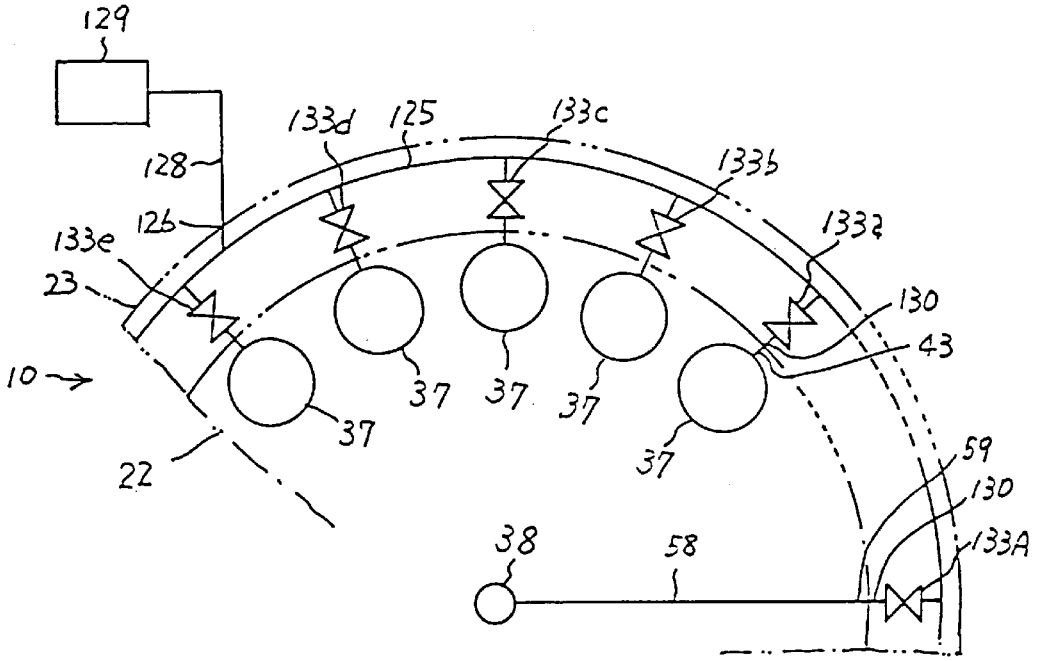
FIG.50 (PRIOR ART)
FIG. 50 is a view showing the relationships among drive means, valves, and an air supply.
Figure 51:
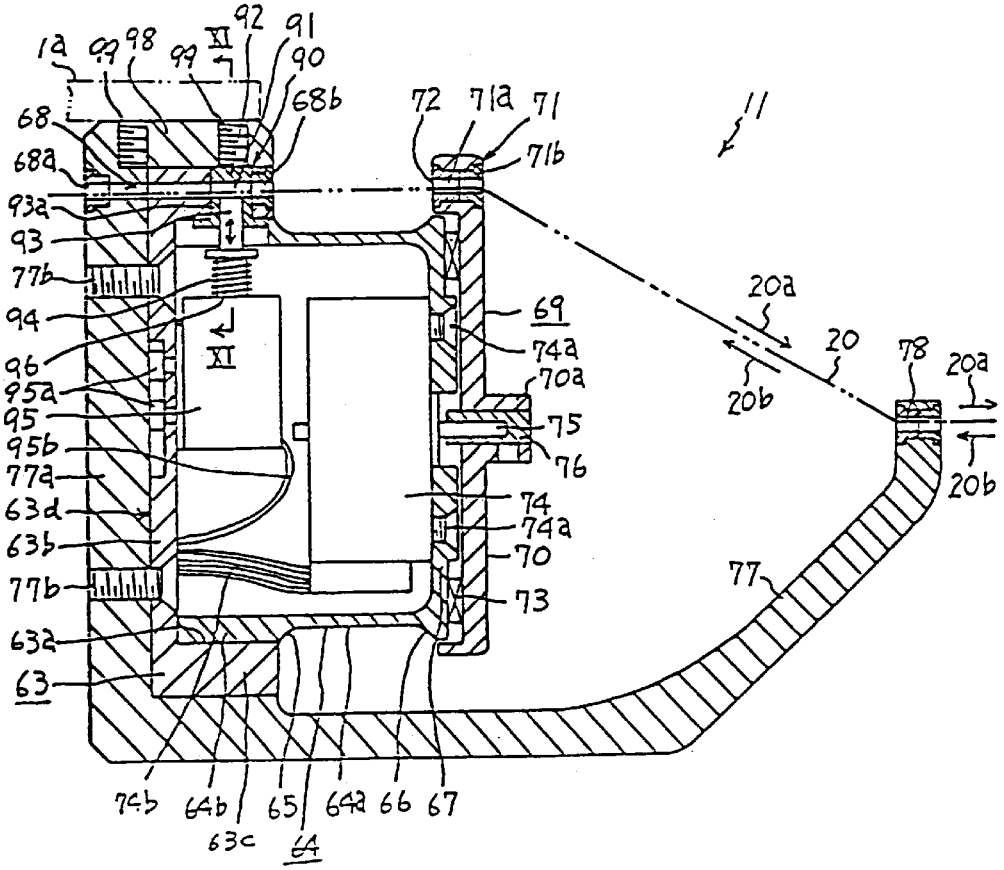
FIG.51 (PRIOR ART)
FIG. 51 is a longitudinal section view of a retraction device.

FIGS. 44 and 45 show a further embodiment of the thread supply and the thread selection device. In the figures, 447 designates a base on which plural bobbin holders are disposed, which is horizontally rotatable about the center with respect to the head frame of the sewing machine, and which is rotated by a driving device (not shown). The reference numeral 448 designates cylindrical thread guides which are arranged on the same circumference which is centered at the rotation center of the base 447. The reference numeral 449 designates an opening which is formed in a place of each of the thread guides 448 on the same side, for example, on the side of the center, and 450 designates a clamping roller disposed in a place opposing the opening 449. The reference numeral 451 designates thread guides. On the other hand, 452 designates an arm. The basal portion of the arm is pivotally attached to a stationary portion of the sewing machine, for example, the head frame 4. The arm can be tilted in the direction of an arrow by a driving device which is not shown, such as an air cylinder. The reference numeral 453 designates a thread feed roller which is disposed at the free end portion of the arm 452, and which can be rotated by a predetermined angle by a driving motor (not shown) such as a pulse motor.

In this configuration, the threads 20 are respectively pulled out from the plural bobbins 21 mounted on the base 447, and the threads 20 hang in the thread guides 448 through the thread guides 451. Under this state, the base 447 is rotated to a predetermined position in response to thread selection instructions so that one thread guide 448 is positioned above the extraction place 208. Thereafter, the arm 452 is tilted and the thread feed roller 453 is pressed against the clamping roller 450 of the thread guide 448 through the opening 449, and rotated in the direction of an arrow of FIG. 45, so that the thread 20 is fed out to the extraction place 208. When the base 447 is rotated, the arm 452 is elevated and the thread feed roller 453 is retracted, thereby preventing the roller from interfering with the thread guide 448.

We claim:

1. A sewing machine which performs a stitching operation using multiple kinds of threads, characterized in that said machine comprises:

(a) a plurality of thread supplies for respectively supplying threads for stitching;

(b) a thread selection device which selects an arbitrary thread from plural threads supplied from said thread supplies, and which extracts the thread at an extraction place;

(c) a stitching needle;

(d) a positioning mechanism for positioning the thread at the thread extraction place of said thread selection device;

(e) a cutting member for cutting off a front end portion of the positioned thread at a predetermined position; and (f) a thread catch mechanism which nips the front end portion of the thread extracted to the thread extraction place of said thread selection device, and which moves the front end portion of the thread to a position opposing a thread eye of said needle, while maintaining the nipping state.

2. In a sewing machine which performs a stitching operation using multiple kinds of threads, and which comprises:

(a) a plurality of thread supplies for respectively supplying threads for stitching;

(b) a thread selection device which selects and extracts an arbitrary thread from plural threads supplied from said thread supplies; and (c) a needle for conducting stitching using the extracted thread, said sewing machine is characterized in that said thread selection device comprises:

(d) plural inlets for respectively introducing the threads; and (e) an outlet for feeding out the selected thread toward an extraction place and configured so that an arbitrary thread among the plural threads introduced into said inlets is selectively fed out from said outlet to the extraction place by an air flow;

(f) said thread selection device comprising a positioning mechanism for suppressing lateral fluctuation of the thread fed to the extraction place, the lateral fluctuation suppression being caused by the air flow, and for positioning the thread; said positioning mechanism positioning the thread at the thread extraction place of said thread selection device and including an outlet through which said thread exits, an inlet downstream of said outlet into which said thread enters, a clamping means selectively clamping said thread at said outlet in a predetermined position at said outlet, guiding means at said inlet for guiding said thread along a predetermined path and drawing means at said inlet for drawing said thread along said path and in a downstream direction.

3. In a sewing machine which performs a stitching operation using multiple kinds of threads, characterized in that said machine comprises:

(a) a plurality of thread supplies for respectively supplying threads for stitching;

(b) a thread selection device which selects an arbitrary thread from plural threads supplied from said thread supplies, and which extracts the thread; and (c) a needle for conducting stitching using the extracted thread;

(d) said sewing machine is characterized in that in a place where a front end portion of the extracted thread is to be passed through a thread eye of said needle, a suction nozzle for sucking the front end portion of the thread to one side of the thread eye is disposed in close proximity, and guiding means comprising a guide hole for guiding the front end portion of the thread is disposed in the other side of the thread eye;

(e) said guide hole having one end of a small diameter corresponding to the thread eye of the stitching needle, and another end of a diameter which is larger than the small diameter, an inner face of said guide hole being a guide face for guiding the thread from the other end to the one end, the thread being pulled by air and an air flow;

(f) said guiding means is configured by two members so that said guiding means can be split into a state where a range of said guide hole from the one end to the other end is divided into two portions;

(g) when the thread is to be passed through the thread eye of said needle, the two members of said guiding means are integrated with each other, whereby said guide hole is configured as a guide hole in which a whole periphery is closed, and the front end portion of the thread is passed through the thread eye by an air flow generated by a suction force of said suction nozzle; and (h) after the thread is passed over, the two members are separated from each other, whereby said guide hole is opened so that the thread passed through the thread eye can be removed from said guide hole.

4. A sewing machine which performs a stitching operation using multiple kinds of threads according to claim 3 characterized in that said guiding means is supported so as to be reciprocally movable under a state where said stitching needle moves between split faces of said two members, and said two members of said guiding means are urged in a direction along which the respective split faces are pressingly contacted with each other.

* * * * *